US007886899B2

(12) United States Patent
Frutin

(10) Patent No.: US 7,886,899 B2
(45) Date of Patent: Feb. 15, 2011

(54) CONTAINER CLOSURE HAVING MEANS FOR INTRODUCING AN ADDITIVE INTO THE CONTENTS OF THE CONTAINER

(75) Inventor: Bernard Derek Frutin, Renfrewshire (GB)

(73) Assignee: Gizmo Packaging Limited, Deanpark, Renfrewshire (GB)

( * ) Notice: Subject to any disclaimer, the term of this patent is extended or adjusted under 35 U.S.C. 154(b) by 0 days.

(21) Appl. No.: 12/226,887

(22) PCT Filed: May 3, 2007

(86) PCT No.: PCT/GB2007/050236

§ 371 (c)(1),
(2), (4) Date: Apr. 6, 2009

(87) PCT Pub. No.: WO2007/129116

PCT Pub. Date: Nov. 15, 2007

(65) Prior Publication Data

US 2009/0236244 A1 Sep. 24, 2009

(30) Foreign Application Priority Data

May 3, 2006 (GB) ..... 0608638.3
Aug. 11, 2006 (GB) ..... 0615991.7
Jan. 15, 2007 (GB) ..... 0700732.1

(51) Int. Cl.
*B65D 25/08* (2006.01)
*B65D 81/32* (2006.01)
*B67B 3/28* (2006.01)
*B67D 7/74* (2010.01)

(52) U.S. Cl. ..... 206/221; 53/471; 222/145.6; 426/115

(58) Field of Classification Search ..... 206/219, 206/221–222; 222/80–83, 129, 145.1, 145.6, 222/145.5; 426/112, 115; 53/467, 471
See application file for complete search history.

(56) References Cited

U.S. PATENT DOCUMENTS 4,070,249 A * 1/1978 Janin et al. ..... 206/219
6,561,232 B1 * 5/2003 Frutin ..... 141/9

(Continued)

FOREIGN PATENT DOCUMENTS

DE 299 16 436 2/2001

(Continued)

*Primary Examiner*—Bryon P Gehman
(74) *Attorney, Agent, or Firm*—Drinker Biddle & Reath LLP

(57) ABSTRACT

A closure device with a fluid chamber containing an additive. The additive can be introduced and mixed into a liquid on the container by the closure device. The closure device includes a cap member having a fluid chamber and a housing having a plug member. The cap member is provided with a primary engagement member which engages with a corresponding primary engagement member provided on the housing to allow the cap member to be lifted relative to the housing from a closed position in which the plug member closes an aperture in the fluid chamber to an open position in which the plug member is at least partially withdrawn from the aperture, thereby allowing the additive to pass from the fluid chamber to the liquid in the bottle. The closure device enables mixing of the additive and liquid in the bottle without opening the closure.

54 Claims, 14 Drawing Sheets

U.S. PATENT DOCUMENTS

| | | | | |
|---|---|---|---|---|
| 6,763,939 | B2 * | 7/2004 | Alticosalian | 206/222 |
| 6,843,368 | B1 | 1/2005 | Frutin | |
| 6,908,011 | B2 * | 6/2005 | Cho | 222/83 |
| 6,948,642 | B2 * | 9/2005 | Awad | 222/80 |
| 6,974,024 | B2 * | 12/2005 | Cho | 206/219 |
| 6,994,211 | B2 * | 2/2006 | Cho | 206/221 |
| 7,325,676 | B2 * | 2/2008 | Galaz Rodriguez | 206/219 |
| 2004/0200740 | A1 | 10/2004 | Cho | |

FOREIGN PATENT DOCUMENTS

| | | |
|---|---|---|
| EP | 1 270 435 | 1/2003 |
| JP | 2006001581 | 1/2006 |
| WO | WO 01/83313 | 11/2001 |

* cited by examiner

CONTAINER CLOSURE HAVING MEANS FOR INTRODUCING AN ADDITIVE INTO THE CONTENTS OF THE CONTAINER

FIELD OF THE INVENTION

The present invention relates to a closure device for releasing an additive liquid into a liquid in a container by operation of the closure device and to a container including such a closure device. The invention also relates to a method of assembling a closure device and a method of introducing an additive liquid by means of operating a closure device.

BACKGROUND

In a number of applications, such as mixtures of different liquids, it may be necessary to release and mix an additive liquid into another liquid shortly before the liquid mixture is used. It may not be possible or desirable to store the liquids in a premixed form, as they may react undesirably with each other when stored as the mixture for a period of time. An example of this may be two component pharmaceuticals which have a longer shelf life when unmixed than they do when mixed. However, it can also apply to other liquids or to mixtures of liquids and gases, such as water, alcoholic beverages, other beverages, and other solvents or solutions. The liquid to which the additive liquid is introduced may be a carbonated or a non-carbonated liquid.

An assembly for releasing an additive liquid into a liquid in a container upon release of a closure from the container is known from the prior art. International Patent Application WO97/05039 discloses a device for releasing a liquid into another liquid held in a container. The known device is for use with containers having releasable closures. The device according to the prior art comprises a fluid chamber for storing a fluid. The fluid chamber is positioned adjacent an opening in the container. The fluid chamber comprises a fluid outlet for releasing fluid into the liquid.

The known device has the disadvantage that the closure must be at least partially opened to enable the mixing of the fluid stored in the fluid chamber with the liquid in the container. Moreover the device is complex to manufacture and requires many parts.

SUMMARY OF THE INVENTION

According to a first aspect of the present invention there is provided a closure device for use with a container having a main liquid compartment and an opening with a neck, the closure device comprising a cap member defining a fluid chamber and a housing having a plug member sealingly engageable in an aperture in a bottom wall of the fluid chamber, wherein the cap member is provided with a primary engagement means which engages with a corresponding primary engagement means provided on the housing to allow the cap member to be lifted relative to the housing from a closed position in which the plug member closes the aperture to an open position in which the plug member is at least partially withdrawn from the aperture to provide a communication path in use from the fluid chamber to the main liquid compartment.

The housing may include an inner housing wall adapted to fit inside the neck of the opening and the closure device includes sealing means which seals between the fluid chamber and the inner housing wall. This maintains a seal between the fluid chamber and inner housing wall, and therefore between the fluid chamber and the neck as the cap member and fluid chamber are lifted relative to the housing and container, in both the closed and open positions. The contents of the fluid chamber can thus pass into the main liquid compartment and be mixed, for example by shaking the container without risk of the contents escaping between the closure member and the container.

In a preferred embodiment the primary engagement means on the cap member includes an internal thread and the primary engagement means on the housing includes an external thread so that the cap member is lifted relative to the housing by rotation of the cap member. However other forms of primary engagement means are possible, for example a bayonet type engagement or a friction pull engagement or a longitudinal sliding engagement, or any other suitable form of engagement. The primary engagement means may prevent the cap member from becoming completely separated from each other.

The cap member may include a top cap wall, an outer cap wall on which is provided the internal thread and an inner cap wall extending from the top cap wall to the bottom wall and arranged inside the outer cap wall. The bottom wall may be formed separately from the remainder of the cap member, which may be formed as a single moulding.

The fluid chamber may be defined by the top cap wall, the inner cap wall and the bottom wall.

The housing may comprise an outer housing wall on which is provided the external thread. The thread may have a relatively steep angle, so that the cap member rises quickly when rotated.

The outer housing wall may be provided with an internal secondary thread adapted in use to engage with an external secondary thread provided on a neck of an opening of the container. Thus in use the outer housing wall may be screwed onto outside of the neck.

In one embodiment, the primary engagement means on the housing may comprise an external thread provided on an upper portion of the housing which in use extends above the neck of the opening.

The housing may further comprise an inner housing wall arranged inside the outer housing wall and provided with internal sealing means to seal against an outer surface of the inner cap wall and external sealing means to seal against an internal surface of the neck of the opening. The inner housing wall may be connected to the outer housing wall by a web which sits on top of the neck in use. The web may be open, closed, solid or any other suitable construction to connect the inner housing wall to the outer housing wall.

The housing may further comprise a frame which supports the plug member so that the plug member is arranged inside the inner housing wall and extends upwardly towards the fluid chamber in use. The frame may include apertures allowing fluid passage therethrough, to avoid the creation of a vacuum between the fluid chamber and housing, so that the housing is free to slide relative to the cap member when the cap member is inserted into or withdrawn from the housing. The apertures also discourage liquid from lying in the frame after firing which minimise any residue of liquid in the frame.

The plug member may include a nozzle directed away from the fluid chamber.

The plug member may include a cylindrical outer surface which engages with a sealing means provided in the bottom wall. The sealing means must be capable of holding pressurised fluid in the fluid chamber when this fluid is at higher pressure than the contents of the container.

The sealing means may comprise an upper seal which seals against the cylindrical outer surface of the plug member when the cap member is in the closed position and which allows the passage of fluid between the upper seal and the plug member when the cap member is in the open position.

The sealing means may comprise a lower seal which seals against the cylindrical outer surface of the plug member when the cap member is in the closed and open positions. This ensures that in the open position pressurised fluid can only escape into the container through the communication path and nozzle, and does not leak around the plug member.

The plug member may include an internal fluid passage which extends to the cylindrical outer surface at a position below the upper seal when the cap member is in the closed position, the internal fluid passage being in communication with the nozzle.

The cap member may include an anti-tamper strip provided on the cap member to prevent rotation of the cap member relative to the housing without at least partial removal of the anti-tamper strip.

The anti-tamper strip may comprise an extension of the outer cap wall connected to the outer cap wall by a neck portion thinner than the outer cap wall, the extension being provided with a flange which engages beneath the outer housing wall to prevent lifting of the cap member relative to the housing. The strip may have a tab which can be pulled to tear the strip from the outer cap wall along the neck.

The primary engagement means of the cap member and housing may include mutually engageable detent means to prevent the rotation of the cap member relative to the housing beyond a predetermined limiting angle of rotation. When the cap member is rotated, it initially rotates relative to the housing, but once the detent means engage the cap member and housing rotate together.

The housing may include an anti-tamper device which prevents rotation of the cap member and housing relative to the neck of the container until a predetermined torque is applied to the cap member.

The anti-tamper device may comprise an extension of the outer housing wall connected to the outer housing wall by at least one neck portion of reduced cross-sectional area relative to the outer housing wall, the extension being provided with a detent means adapted to engage in use with a detent means provided on the neck of the container to prevent lifting of the housing relative to the neck without rupture of the at least one neck portion.

The fluid chamber may contain an additive liquid and a head space of pressurised gas.

According to a second aspect of the present invention there is provided a container having a main liquid compartment, an opening having a neck, and a closure device closing said opening, wherein the closure device comprises a cap member defining a fluid chamber and a housing secured to the neck of the container, the housing having a plug member sealingly engageable in an aperture in a bottom wall of the fluid chamber, wherein the cap member is provided with a primary engagement means which engages with a corresponding primary engagement means provided on the housing to allow the cap member to be lifted relative to the housing from a closed position in which the plug member closes the aperture to an open position in which the plug member is at least partially withdrawn from the aperture to provide a communication path in use from the fluid chamber to the main liquid compartment.

The housing may include an inner housing wall arranged inside the neck of the opening and the closure device includes sealing means which seals between the fluid chamber and the inner housing wall. This maintains a seal between the fluid chamber and inner housing wall in both the closed and open positions.

The primary engagement means on the cap member may include an internal thread and the primary engagement means on the housing includes an external thread, to allow the cap member to be lifted relative to the housing by rotation of the cap member.

The main liquid compartment may contain a primary liquid, which may contain water or be a beverage. However the primary liquid could be an alcoholic beverage, a cosmetic preparation, a pharmaceutical product, a dairy product or an agricultural feed or other product, or any other suitable liquid or semi-liquid substance.

The fluid chamber may contain an additive liquid and may contain a head space of pressurised gas.

The cap member may include a top cap wall, an outer cap wall on which is provided the internal thread and an inner cap wall extending from the top cap wall to the bottom wall and arranged inside the outer cap wall.

The fluid chamber may be defined by the top cap wall, the inner cap wall and the bottom wall.

The housing may comprise an outer housing wall on which is provided the external thread. The outer housing wall may be located outside the neck of the container and may be provided with an internal secondary thread engaged with an external secondary thread provided on the neck of the container.

In one embodiment, the primary engagement means on the housing may comprise an external thread provided on an upper portion of the housing which extends above the neck of the container.

The housing may further comprise an inner housing wall arranged inside the neck of the container and provided with internal sealing means to seal against an outer surface of the inner cap wall and external sealing means to seal against an internal surface of the neck of the opening.

The housing may further comprise a frame which supports the plug member so that the plug member is arranged inside the inner housing wall and extends upwardly towards the fluid chamber in use.

The plug member may include a nozzle directed away from the fluid chamber.

The plug member may include a cylindrical outer surface which engages with a sealing means provided in the bottom wall.

The sealing means may comprise an upper seal which seals against the cylindrical outer surface of the plug member when the cap member is in the closed position and which allows the passage of fluid between the upper seal and the plug member when the cap member is in the open position. The sealing means may comprise a lower seal which seals against the cylindrical outer surface of the plug member when the cap member is in the closed and open positions.

The plug member may include an internal fluid passage which extends to the cylindrical outer surface at a position below the upper seal when the cap member is in the closed position, the internal fluid passage being in communication with the nozzle.

The cap member may include an anti-tamper strip to prevent rotation of the cap member relative to the housing without at least partial removal of the anti-tamper strip. The anti-tamper strip may comprise an extension of the outer cap wall connected to the outer cap wall by a neck portion thinner than the outer cap wall, the extension being provided with a flange which engages beneath the outer housing wall to prevent lifting of the cap member relative to the housing.

The primary engagement means of the cap member and housing may include mutually engageable detent means to prevent the rotation of the cap member relative to the housing beyond a predetermined limiting angle of rotation.

The housing may include an anti-tamper device which prevents rotation of the cap member and housing relative to the neck of the container until a predetermined torque is applied to the cap member. The anti-tamper device may comprise an extension of the outer housing wall connected to the outer housing wall by at least one neck portion of reduced cross-sectional area relative to the outer housing wall, the extension being provided with a detent means adapted to engage in use with a detent means provided on the neck of the container to prevent lifting of the housing relative to the neck without rupture of the at least one neck portion.

According to a third aspect of the invention there is provided a method of assembling a closure device containing additive liquid for introduction into a main liquid compartment of a container, the method comprising providing a cap member, securing a bottom wall to said cap member to define a fluid chamber, inverting the cap member and introducing an additive liquid into the fluid chamber through an aperture in the bottom wall, providing a housing having a plug member, attaching a housing to the cap member by relative axial movement of the housing and cap member so that the plug member enters and closes the aperture in the bottom wall of the fluid chamber.

An inner housing wall of the housing may enclose and seal against the fluid chamber.

The relative axial movement of the housing and cap member may be accomplished by engagement of an external thread on the housing with an internal thread on the cap member.

The method may include the further step of purging the fluid chamber before introduction of the additive liquid, for example purging with nitrogen or any other suitable gas.

The method may include the further step of pressurising the fluid chamber.

The pressurising step may be accomplished by providing pressurised fluid to a passage in said plug member, the passage being in communication with a valve means which prevents release of the pressurised fluid from the fluid chamber. The valve means may comprise a seal which engages with the plug member when the aperture is closed by the plug member. The upper seal is arranged to function as a flap valve such that it will allow the introduction of pressurised fluid into the fluid chamber, but once pressurised the seal is urged against the plug member to seal the fluid chamber closed. The pressurising step may be accomplished by scavenging pressurised gas from pressurised contents of the main liquid compartment of the container, after the closure device has been secured to the container.

The pressurised fluid may be a gas which forms a head space in the fluid chamber of between 0% and 60% of the volume of the fluid chamber.

The step of securing the bottom wall to the cap member may include sealing the bottom wall to a free edge of an inner cylindrical wall of the cap member.

The method may include the further step of securing the closure device to a neck of a container having a main liquid compartment by engagement of an internal thread on the housing with an external thread on the neck of the container.

The cap member may be a push fit onto the closure device to lock the cap member onto the closure device. Alternatively or additionally, the closure device may be a push fit onto the neck of a container to lock the closure device onto the container.

According to a fourth aspect of the invention there is provided a method of introducing an additive liquid into a main liquid compartment of a container, the method comprising the steps of raising a cap member of a closure device and a fluid chamber defined by said cap member relative to a housing, causing a plug member provided on said housing to move relative to the cap member from a closed position in which an aperture provided in a bottom wall of said fluid chamber is closed by said plug member to an open position in which the plug member is at least partially withdrawn from the aperture to provide a communication path from the fluid chamber to the main liquid compartment, releasing pressurised liquid from said fluid chamber along said communication path into said main liquid compartment, and rotating the cap member further to remove the cap member and housing from the container.

Optionally during the raising of the fluid chamber relative to the housing a seal is maintained between the fluid chamber and an inner housing wall of the housing arranged in the neck of the container.

The cap member may be raised by rotating the cap member such that the fluid chamber is raised by screw thread action relative to the housing.

The cap member may be rotated by a first angle of between 0° and 90°, optimally about 45°, from the closed position to the open position. Further rotation of the cap member may be limited to a second angle of between 0° and 90°, optimally about 45°, by the mutual engagement of detent means provided on the cap member and housing. The second angle is predetermined by the position of the detent means. It is selected so that it is sufficient to ensure opening of the plug member and consequent mixing of the additive liquid, allowing for manufacturing tolerances.

The raising of said cap member relative to the housing may be achieved by engagement of an internal thread on the cap member with an external thread on the housing.

The internal thread may be provided on an outer cap wall of the cap member.

The fluid chamber may be defined by a top cap wall, a bottom wall and an inner cap wall extending from the top cap wall to the bottom wall and arranged inside the outer cap wall.

The external thread may be provided on the outer face of an outer housing wall.

The rotation of the cap member further to remove the cap member and housing from the container may be achieved by engagement of an internal secondary thread on the housing with an external secondary thread provided on a neck of an opening of the container.

The internal secondary thread may be provided on the inner face of the outer housing wall.

The inner cap wall may extend inside the neck of the container.

The housing may include an inner housing wall arranged inside the neck of the container, and provided with sealing means to seal between an outer surface of the inner housing wall and an internal surface of the neck of the container.

Optionally, during the raising of said cap member relative to the housing, a sealing means seals between an external surface of the inner cap wall and an internal surface of the inner housing wall.

Optionally the communication path includes a nozzle in the plug member and an internal fluid passage which extends from the nozzle to a position on the surface of the plug member which is in communication with the fluid chamber when the plug member is in the open position.

The method may further include the step of at least partially removing an anti-tamper strip provided at the outer cap wall, thereby allowing rotation of the cap member relative to the housing.

The method further may include the step of applying sufficient torque to the cap member, during the step of rotating the cap member further to remove the cap member and housing from the container, to remove an anti-tamper device.

According to a fifth aspect of the invention there is provided a closure device according to the first aspect, wherein the primary engagement means includes a mutually engaging bayonet coupling provided on the cap member and the housing to allow the cap member to be lifted relative to the housing after rotation of the cap member relative to the housing through a predetermined angle.

The primary engagement means may include longitudinal guidance means provided on the cap member and the housing to allow the cap member to be lifted relative to the housing after removal of the anti-tamper strip.

The primary engagement means may include one or more dogs on one of the cap member and housing which engage on one or more bayonet slots provided on the other of the cap member and housing. The bayonet slots may include one or more of a first horizontal section which allows relative rotation of the cap member and housing in the closed position, a vertical section which allows sliding of the cap member relative to the housing from the closed position to the open position, and a second horizontal section which allows relative rotation of the cap member and housing in the open position. The vertical section and the dogs may form the longitudinal guidance means.

According to a sixth aspect of the invention there is provided a closure device for use with a container having a neck and a main liquid compartment, the closure device comprising:

a cap member including a top cap wall, a bottom wall and an inner cap wall extending from the top cap wall to the bottom wall, together defining a fluid chamber for a liquid additive, and a housing adapted to be secured in the neck of the container, wherein the cap member and housing are arranged to permit relative movement of the cap member and housing from a closed position in which fluid chamber is sealed closed to an open position in which a communication path is provided in use from the fluid chamber to the main liquid compartment, wherein the bottom wall includes a first frame portion formed from a first relatively rigid material and a second sealing portion formed from a second relatively flexible material.

The sealing portion may be provided in a plurality of discrete positions, and may be arranged to seal against the inner cap wall.

The bottom wall may be provided with an aperture for insertion of a plug member and the sealing portion may be arranged to seal between the aperture and the plug member.

The top cap wall and inner cap wall may comprise a single moulded component and the bottom wall comprises a separate moulded component. The bottom wall may be formed by inset moulding.

According to a seventh aspect of the present invention, there is provided a bottle for a liquid comprising an opening closed by a releasable closure device, the bottle comprising a main liquid compartment and a neck, the interior wall of which is positioned at an angle with respect to the axis of the main liquid compartment, wherein the releasable closure device comprises a cap member defining a fluid chamber and a housing, the fluid chamber having an aperture in a bottom wall of the fluid chamber, wherein the cap member is provided with a primary engagement means which engages with a corresponding primary engagement means provided on the housing to allow the cap member to be lifted relative to the housing from a closed position in which the aperture is closed to an open position in which the aperture is at least partially open to provide a communication path in use from the fluid chamber to the main liquid compartment.

The closure device may be a closure device according to the first aspect of the invention.

Surprisingly, the inclination of the interior wall of the neck will influence the result of the mixing between the fluids released from the device and the liquid inside the container. Whether good mixing will result, depends upon the respective length of the opening and the inclination of the interior wall thereof with respect to the main axis of the container, as is described below.

The presence of the angle between the interior wall of the opening and the main axis of the container allows the jet of fluid which is released from the device to be introduced into the body of the liquid and to obtain good mixing, without the need for dip tubes or similar devices.

According to a preferred embodiment the assembly comprises a bottle with a neck, the neck providing an opening to the main liquid compartment of the bottle, wherein the device for releasing a fluid into a liquid is positioned in the neck and wherein the interior wall of the neck is positioned at an angle with respect to the main axis of the main liquid compartment, wherein said angle is at least 30 and wherein the neck has a length of at least 50 mm.

Typically the neck has a diameter of 20-40 mm, preferably 28-38 mm.

BRIEF DESCRIPTION OF THE DRAWINGS

The invention will be described, by way of example only, with reference to the drawings in which.

DESCRIPTION OF THE PREFERRED EMBODIMENTS

Figure 1:
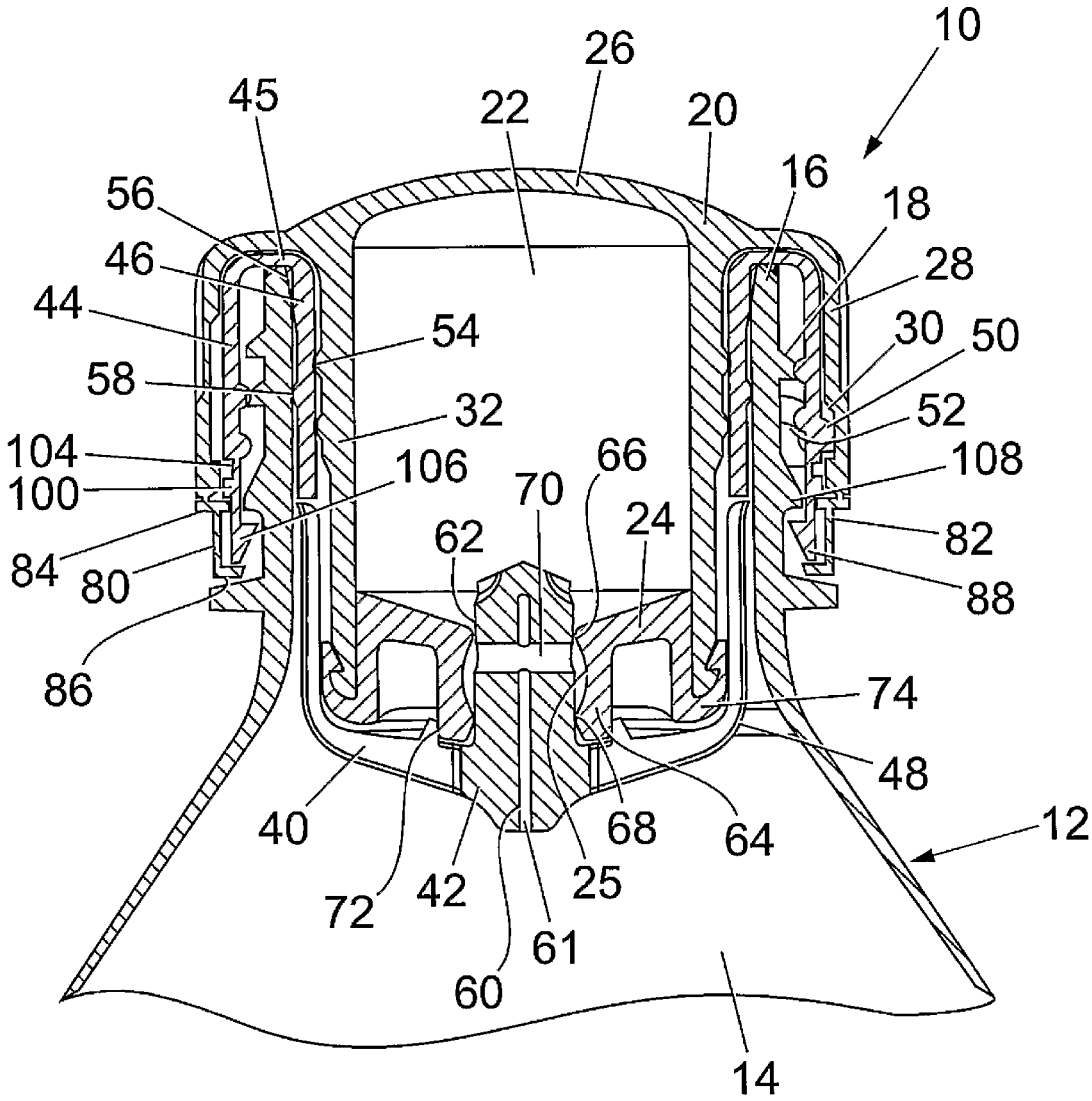
FIG. 1 shows a cross-section through a closure device according to the invention secured to the neck of a container.
Figure 2:
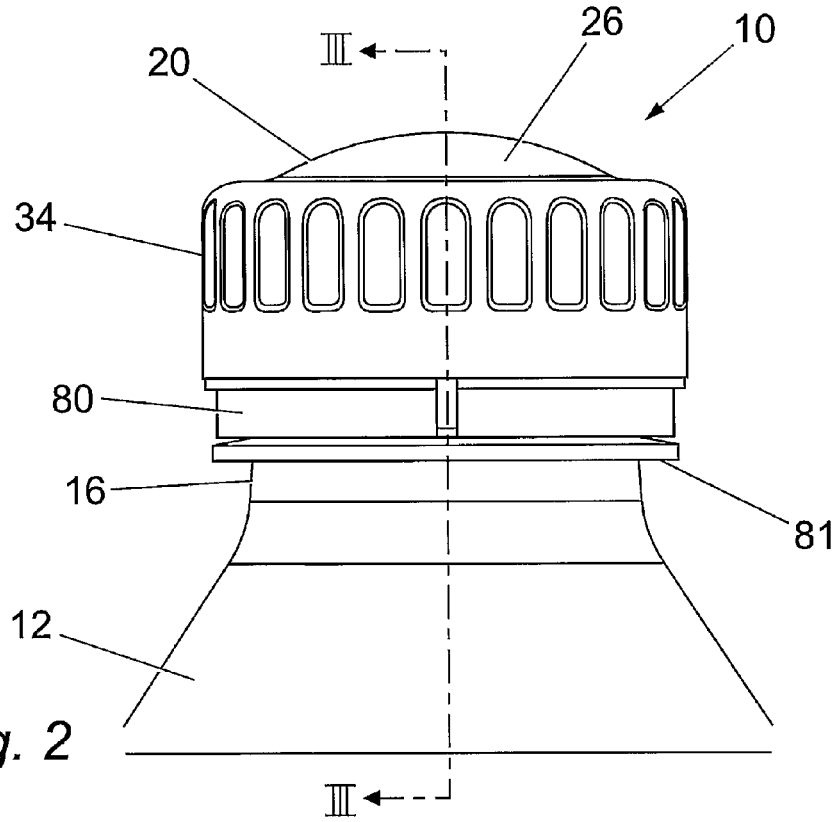
FIG. 2 shows a side elevation of the closure device of FIG. 1.
Figure 3:
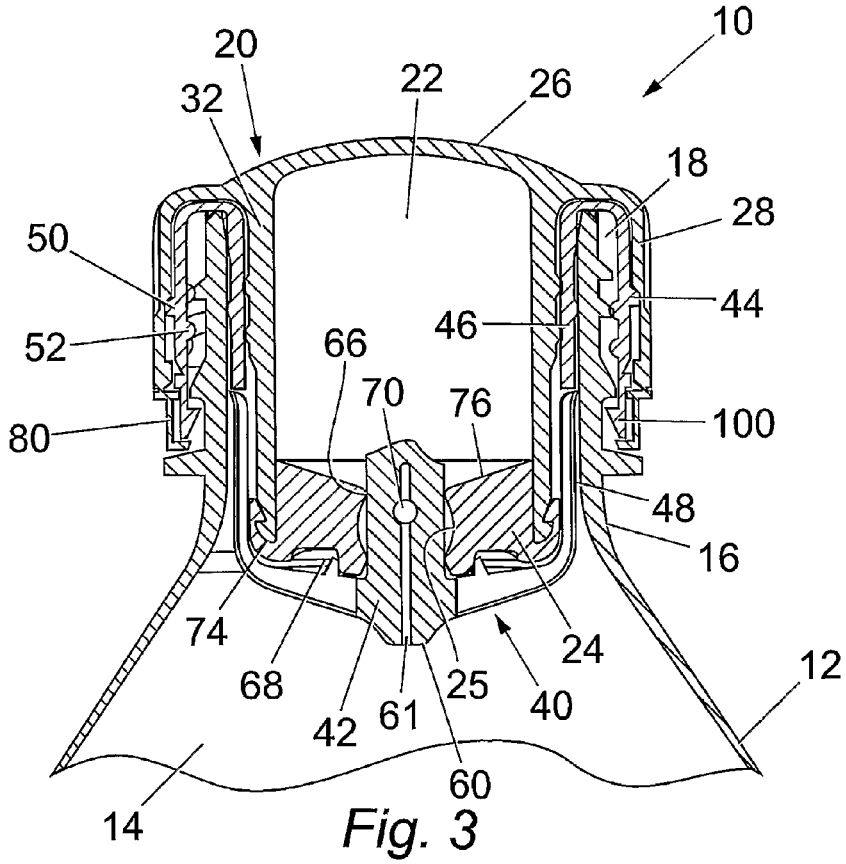
FIG. 3 is a cross-section on line III-III in FIG. 2.

With reference to FIGS. 1 to 3 there is shown a closure device 10 together with the upper part of a container 12. The container is a standard PET bottle having a main liquid compartment 14 and a standard 30 mm neck 16 with an external thread 18. For the purposes of this invention the thread is described as a secondary thread 18.

The closure device 10 comprises two main parts, a cap member 20, which defines a fluid chamber 22, and a housing 40. The cap member 20 includes a bottom wall 24, which although it may be made of a different material is secured to the remainder of the cap member 20 to form a unitary member. An aperture 25 is provided in the bottom wall 24. The cap member 20 includes a top cap wall 26, an outer cap wall 28, and an inner cap wall 32, which may all be formed as a single moulding from polypropylene or any other suitable plastic. The outer cap wall includes an internal primary thread 30 adapted to engage a corresponding external primary thread on the housing 40, as will be described below. Together the internal and external primary threads form part of the primary engagement means which allow the cap member 20 to be lifted relative to the housing 40. The outer cap wall 28 also includes surface depressions 34 on the outer surface to aid gripping of the outer cap wall. Any suitable surface features may be provided instead of the depressions 34 shown.

The housing 40 is also preferably formed as a unitary polypropylene moulding, although it can be formed from any other suitable material. It comprises a plug member 42 arranged on the central axis of the closure member 10, an outer housing wall 44 adapted to fit outside the neck 16, a web 45 which sits on top of the neck 16, an inner housing wall 46 which extends down from the web 45 inside the neck and which seals against the neck 16, and a frame 48 which extends from the inner housing wall 46 and supports the plug member 42.

The outer housing wall 44 has an external primary thread 50 which engages the internal primary thread 30 on the cap member as part of the primary engagement means. It also has an internal secondary thread 52 which engages the external secondary thread 18 on the neck 16 of the container.

Internal sealing means 54 are provided to seal between the inner cap wall 32 and the inner housing wall 44. In the illustrated example the internal sealing means 54 are formed as ribs on the outer surface of the inner cap wall, but they could be formed as ribs on the inner surface of the inner housing wall, or as any other suitable sealing means. The internal sealing means 54 prevents the contents of the container 12 passing between the inner cap wall 32 and the inner housing wall 44 during storage and while the cap member 20 is raised relative to the housing 40, as later described.

External sealing means in the form of a taper 56 and rib 58 are provided to seal between the inner housing wall 44 and the neck 16 of the container 12. Such seals are well known in the art and serve to prevent the contents of the container 12 passing between the inner housing wall 44 and the neck during storage. A taper seal may be used for the internal sealing means 54 also.

The plug member 42 has a nozzle 60 extending below it. A nozzle passage 61 is provided to convey pressurised liquid from the fluid chamber 22 when the closure device is opened. The plug member 42 is formed with a cylindrical outer surface 62, which engages sealingly with sealing means 64 provided at the aperture 25 in the bottom wall 24. In the example the sealing means comprises an upper seal 66 which when the plug member 42 is in the closed position of FIG. 1 engages with the cylindrical outer surface 62 above an internal fluid passage 70, while a lower seal 68 engages with the cylindrical outer surface 62 below the an internal fluid passage 70.

The upper surface 76 of the bottom wall 24 slopes towards the plug member 42, so that all the liquid is drained from the fluid chamber 22 when the plug member is in the open position. The lower seal 68 is held by a collar 72 provided on the frame 48 which urges the lower seal 68 against the plug member 42.

In the illustrated example the bottom wall 24 includes a flange 74 which locks onto a corresponding flange at the edge of the inner cap wall 32 when the cap member is assembled. However any other suitable method of vapour-tight connection may be used, such as laser welding.

At the lower edge of the outer cap wall 28 is an anti-tamper strip 80, with a tab 81 which can be pulled to remove the strip. The strip is an extension 82 of the outer cap wall 28, connected by a neck portion 84, and engaging the underside 88 of the outer housing wall 44 by a detent flange 86. Such anti-tamper strips are known in the art and are not described further. Until the anti-tamper strip 80 is at least partially removed, the cap member 20 cannot be unscrewed from the housing 40. Once the anti-tamper strip 80 is at least partially removed the cap member 20 can be unscrewed from the housing 40 by interaction of the internal thread 30 on the cap and the external thread 50 on the housing. The threads include mutually engaging detent means 90, 92, best seen in FIG. 4, which serve to limit the relative rotation of the cap member 20 and housing 40. It is to be understood that any suitable mutually engaging shape or protrusion may be used to limit this movement. The anti-tamper strip may be replaced by any other suitable anti-tamper means, or may be omitted.

At the lower edge of the outer housing wall 44 is provided a further anti-tamper device 100. The device is an extension 102 of the outer housing wall 44, connected by one or more neck portions 104, and includes a detent flange 106 which engages a corresponding detent means 108 provided on the container neck 16. Such anti-tamper devices are known in the art and are not described further. A predetermined torque applied to the cap member 20 is required to break the neck portions 104 and allow the housing 40 to be raised on the secondary threads 18, 52 relative to the neck 16. The anti-tamper device 100 remains on the neck 16 of the container 12 below the detent 108. Any other suitable anti-tamper device may be used instead, or it may under certain circumstances be omitted.

FIGS. 4A to 4D show the operation of the closure device of the invention.

Figure 4A:
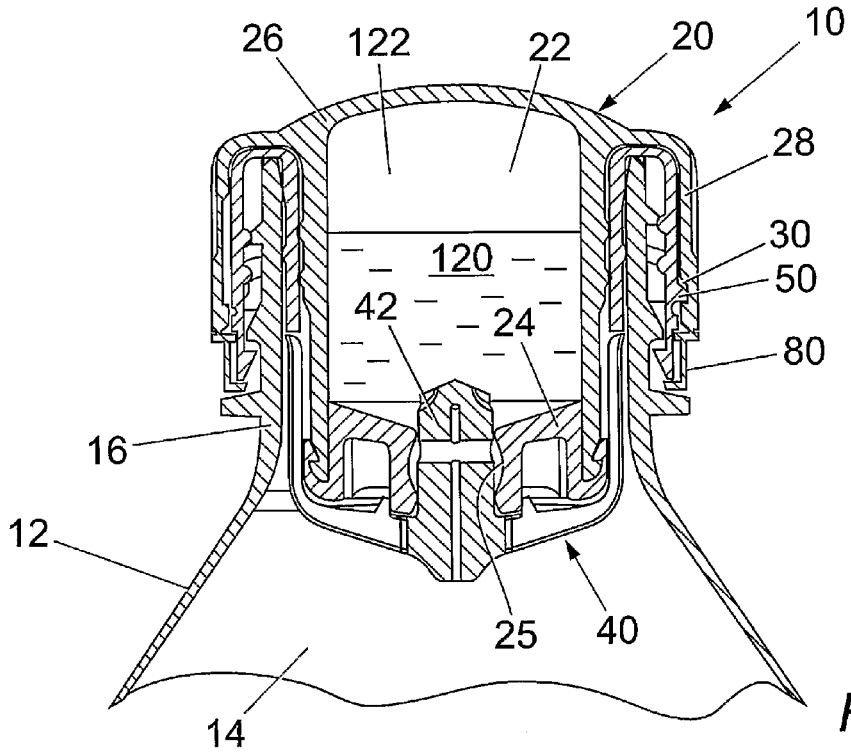
FIGS. 4A, 4B, 4C and 4D are sequential cross-sectional drawings showing the operation of the closure device of FIG. 1 to introduce additive liquid into a container and to remove the closure device from the container.

In FIG. 4A the closure device 10 is secured to a container 12 containing a primary liquid (not shown), for example water in its main liquid compartment 14. The fluid chamber 22 in the cap member contains a liquid additive 120 and a head space 122 of pressurised gas. The closure device 10 is in the closed position, in which the fluid chamber 22 is sealed closed by the plug member 42 which is engaged in the aperture 25 in the bottom wall 24. The housing 40 is screwed fully onto the neck 16 through the secondary threads 18, 52, and the cap member 20 is screwed fully onto the outer housing wall 44 through the internal and external primary threads 30, 50. The contents of the container 12 may be at atmospheric pressure, or may be pressurised to a pressure less than that of the fluid chamber 22. There is a seal 54 provided between the fluid chamber 22 and inner housing wall 46, and further seals are provided between the inner housing wall 46 and the neck 16 so that the contents of the container are sealed from the external atmosphere.

Figure 4B:
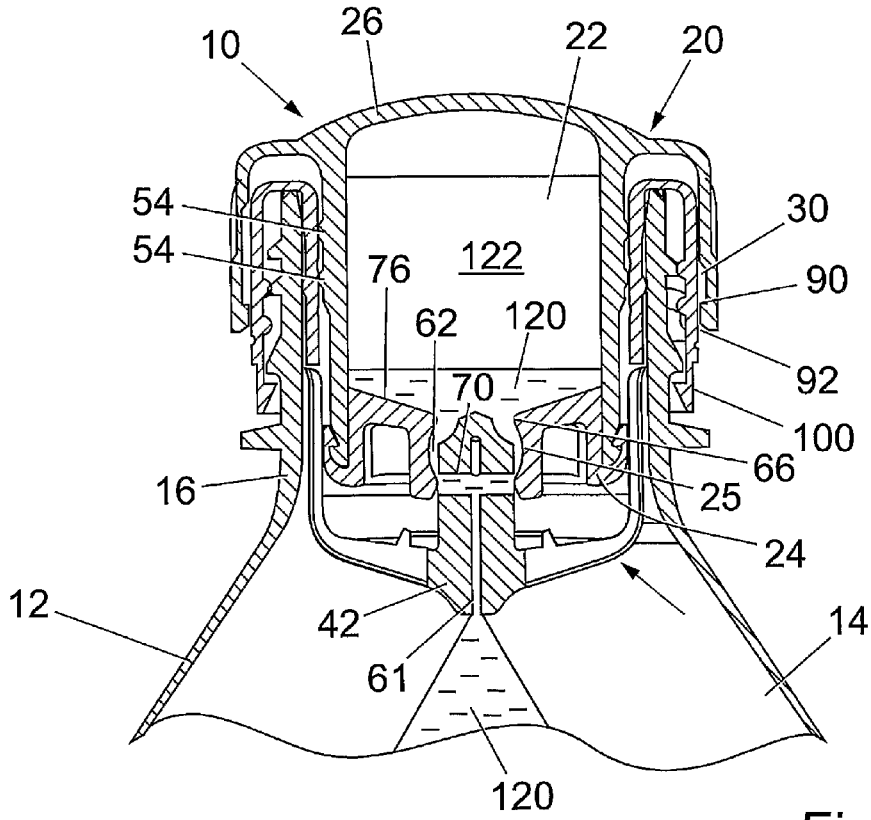

To trigger the firing of the liquid additive 120 into the main liquid compartment 14 of the container 12, the cap member 20 must be unscrewed relative to the housing 40 to the position shown in FIG. 4B, through a first angle of 45° according to the preferred embodiment. However it is to be understood that this first angle may be any desired angle by appropriate selection of the thread and pitch. First the anti-tamper strip 80 is at least partially removed so that the outer cap wall 28 is free to be raised relative to the outer housing wall 44. Then the cap member 20 is grasped and rotated. The primary threads 30, 50 have a relatively large thread angle, so that a relatively large vertical displacement is effected by a relatively small rotation. As the cap member rises, the fluid chamber 22 is lifted away from the plug member 42. When the upper seal 66 of the bottom wall 24 passes above the top of the plug member 42, as shown in FIG. 4B, the main liquid compartment 14 comes into fluid communication with the fluid chamber 22, and the pressurised additive liquid 120 is free to pass between the upper seal 66 and the outer surface 62 of the plug member 42, into the internal fluid passage 70, along the nozzle passage 61 and out of the nozzle 60 into the main liquid compartment 14. The lower seal 68 in the bottom wall 24 continues to seal between the bottom wall 24 and the plug member 42, so that the additive liquid 120 cannot leak into the main liquid compartment 14 along any other path. Typically the primary thread 30, 50 is a standard 30/25 PET bottle thread with 9 mm pitch, of the type used with PET water bottles, and the closure device 10 is arranged so that the additive liquid 120 is fired into the main liquid compartment 14 when the cap member is rotated through 45° from the closed position under optimum tolerance. In practice this angle could be smaller or greater, in the range 0° to 90°.

The volume of the head space 122 is chosen to be sufficiently large so that all the additive liquid 120 is expelled into the main liquid compartment 14. The top surface 76 of the bottom wall 24 slopes down towards the aperture 25, so that under gravity all the additive liquid flows to the aperture. The upper end of the plug member 42 is also shaped to ensure that any liquid thereon drains to the perimeter of the plug member 42.

Figure 4C:
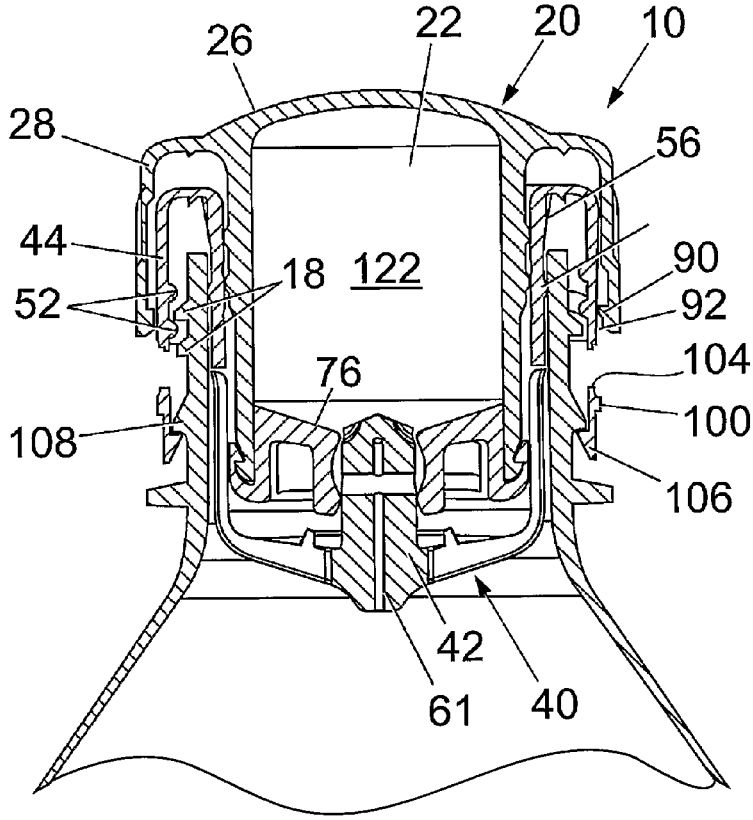
Figure 4D:
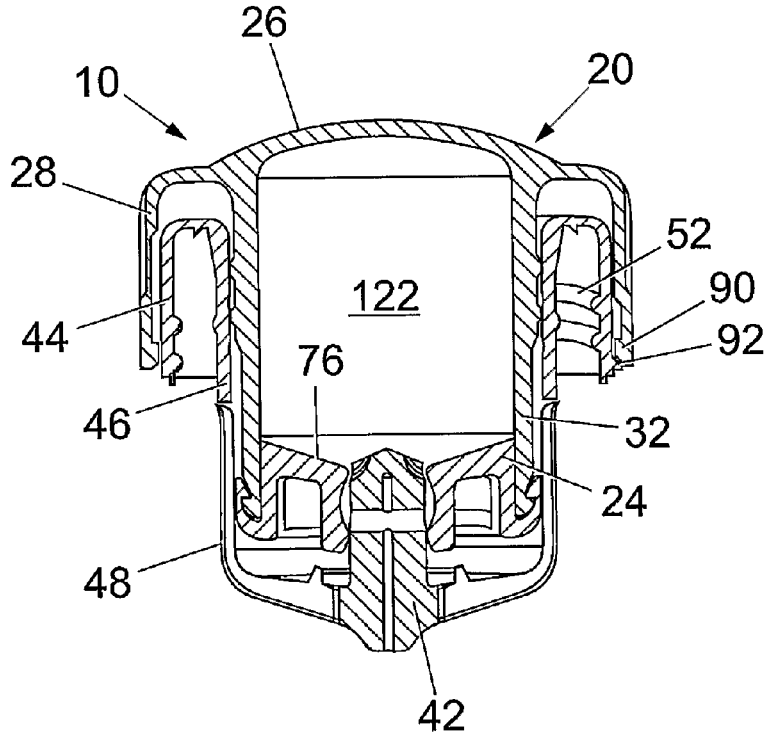

Referring now to FIG. 4C, following release of the additive liquid 120, the cap member 20 is rotated further through a second angle of 45° according to the preferred embodiment, until the mutually engageable detent means 90, 92 on the cap 20 and housing 40 engage with each other and prevent further relative rotation. Typically this happens when the cap member 20 is rotated through a total of 90° from the closed position. At this point the torque on the cap member 20 is transferred to the outer housing wall 44 and the housing 40 begins to rotate relative to the container neck 16. In the illustrated embodiment an anti-tamper device 100 is provided on the housing 40, so an increase torque must be applied to first break the neck portions 104 of the anti-tamper device 100 before the housing can be raised relative to the container 12 by engagement of the secondary threads 18, 52. The secondary threads 18, 52 are typically MCA2 threads of 3.2 mm pitch. FIG. 4C shows the closure device in a partially raised position. As the cap member 20 is rotated, the entire closure device 10 is lifted from the container 12, until it is as shown in FIG. 4D, removed from the container 12.

If required, the closure device 10 can be screwed back onto the container 12, to close the container. As the cap member is rotated, the cap member 20 will rotate back to its original position relative to the housing 40, and then the cap member 20 and housing 40 will rotate together on the external secondary thread 18 provided on the neck 16, until they can be rotated no further and the container 12 is sealed closed.

Figure 5A:
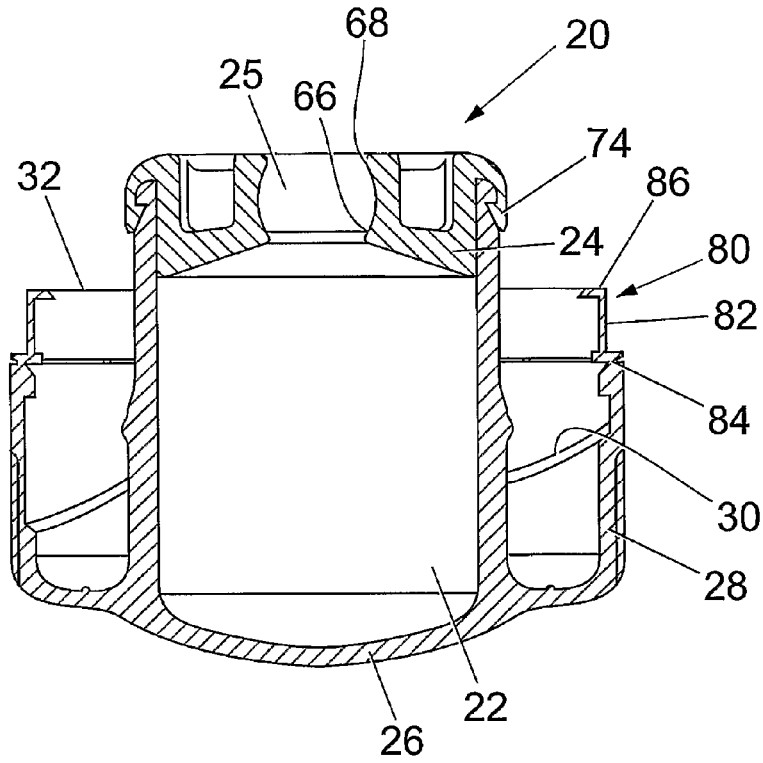
FIGS. 5A and 5B are sequential cross-sectional drawings showing the assembly and filling of the closure device of FIG. 1.
Figure 5B:
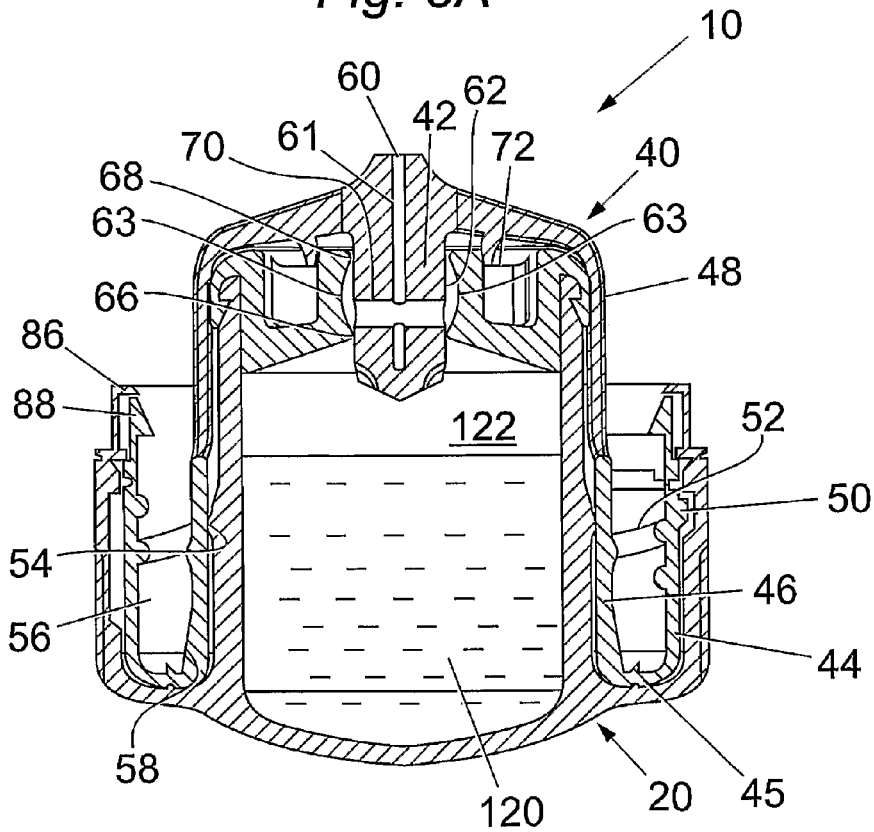

Referring to FIGS. 5A and 5B, there is shown a method of assembling a closure device 10 according to the invention. The cap member 20, without the bottom wall 24, is formed by moulding from polypropylene for example. The housing 40 is also formed separately by moulding from polypropylene for example.

Figure 8:
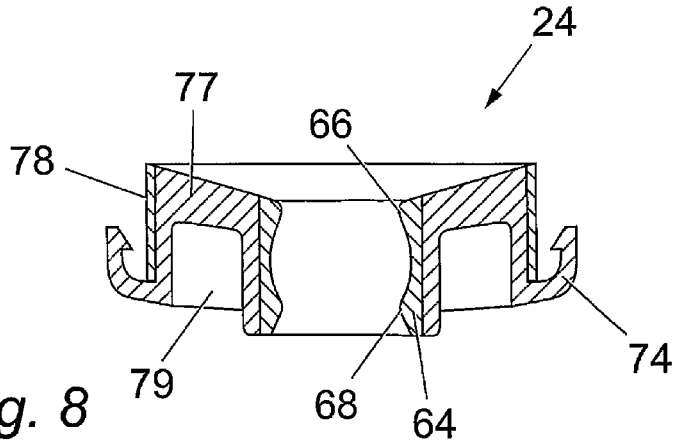
FIG. 8 is a cross-section through one example of a bottom wall of the cap member of the closure device of FIG. 1.

The bottom wall 24 is shown in more detail in FIG. 8. It can be formed of any suitable material and is formed so that it can be readily secured to the inner cap wall 32 of the cap member 20 to form the fluid chamber 22. Although it can be formed of one material, in FIG. 8 it is shown formed from two materials, a frame 77 of a relatively rigid plastic and a sealing portion of relatively flexible material. In the example of FIG. 8 there is a first sealing portion 64 of softer sealing material to provide the upper and lower seals 66, 68 which engage with the plug member 42. There is also a second sealing portion 78 which provides a secure seal against the inner face of the inner cap wall 32. The frame 77 provides the structural strength and rigidity required of the bottom wall 24 to resist the pressure arising from the pressurised fluid chamber 22 in use. Because the material of the frame 77 is relatively strong and stiff, weight may be saved by forming cut-outs 79. A suitable technique for manufacturing the bottom wall 24 is inset moulding, in which the frame 77 is first formed by moulding and then is placed in a second mould and has the sealing portions 64, 78 formed around it. Suitable materials for the sealing portion are natural or synthetic rubber or thermoplastic elastomers. Suitable materials for the frame are metal or rigid plastics.

The bottom wall 24 is secured to the inner cap wall 32 by any appropriate technique, for example by engagement of a detent flange 74 on a corresponding groove in the external face of the inner cap wall 32, or by laser, sonic or spin welding. The fluid chamber 22 is then defined by the bottom wall 24, the top cap wall 26 and the inner cap wall 32.

The cap member 20 is placed in the inverted position shown in FIG. 5A and, after purging with nitrogen or other suitable purging means to remove contaminants, the additive liquid 120 is then introduced into the fluid chamber 22 through the aperture 25 in the bottom wall 24.

The housing 40 is then placed on the cap member 20 by engagement of the external primary thread 50 on the housing 40 with the internal primary thread 30 on the cap member 20 so that the plug member 42 enters and closes the aperture 25 in the bottom wall 24, thereby sealing the additive liquid 120 in the fluid chamber 22, as shown in FIG. 5B.

The fluid chamber 22 may be pressurised either at the time of filling or at any other time before using the closure device 10 to close a container 12. The pressurising step may be accomplished by providing pressurised gas to the nozzle passage 61. The nozzle passage 61 is in communication with an internal fluid passage 70 which exits on the cylindrical outer surface 62 of the of the plug member 42, and so is in communication with the volume 63 between the upper 66 and lower seals 68. The lower seal 68 is held against the plug member 42 by a collar 72 on the housing 40, and continues to seal against the plug member 42 even when the volume 63 is pressurised. The upper seal 66 provides a one-way valve means to enable the fluid chamber 22 to be pressurised. The upper seal 66 functions as a flap valve. When the pressure in the volume 63 is greater than the pressure in the fluid chamber 22 the upper seal is urged away from the plug member 42 so that pressurised gas can flow from the volume 63 past the upper seal 66 to the fluid chamber 22. When the source of pressurised gas is removed, and the pressure in the volume 63 and the nozzle passage 61 reverts to atmospheric pressure, the upper seal 66 is urged against the plug member 42 to seal the fluid chamber 22 closed.

Typically the gas forms a head space 122 in the fluid chamber 22 of between 0% and 60% of the volume of the fluid chamber 22.

After the fluid chamber 22 has been pressurised, the closure device 10 is secured to the neck 16 of a container 12 by engagement of the internal secondary thread 52 on the housing 40 with the external secondary thread 18 on the neck 16 of the container, to seal the contents of the container.

In an alternative embodiment, when used with a pressurised container 10, for example a container containing a carbonated beverage, the fluid chamber need not be pressurised before securing to the neck of the container. The internal pressure of a carbonated beverage may be typically 310 kPa (45 psi), and the one-way valve described above will allow the fluid chamber 22 to reach the same pressure. If the pressure in the main liquid compartment 14 is temporarily increased further, for example to 480 kPa (70 psi) by pasteurisation, then the pressure in the fluid chamber 22 will also reach this pressure by scavenging pressure from the head space in the main liquid compartment 14 through the one-way valve. However when the pressure in the main liquid compartment 14 reverts to its previous pressure, say 310 kPa (45 psi), the pressure in the fluid chamber 22 will remain at the higher pressure, say 480 kPa (70 psi) because the seal 66 will prevent the flow of fluid from the fluid chamber 22. If the headspace 122 in the fluid chamber 22 is sufficiently large, this pressure difference will be sufficient to fire the liquid additive on operation of the closure device.

Figure 6A:
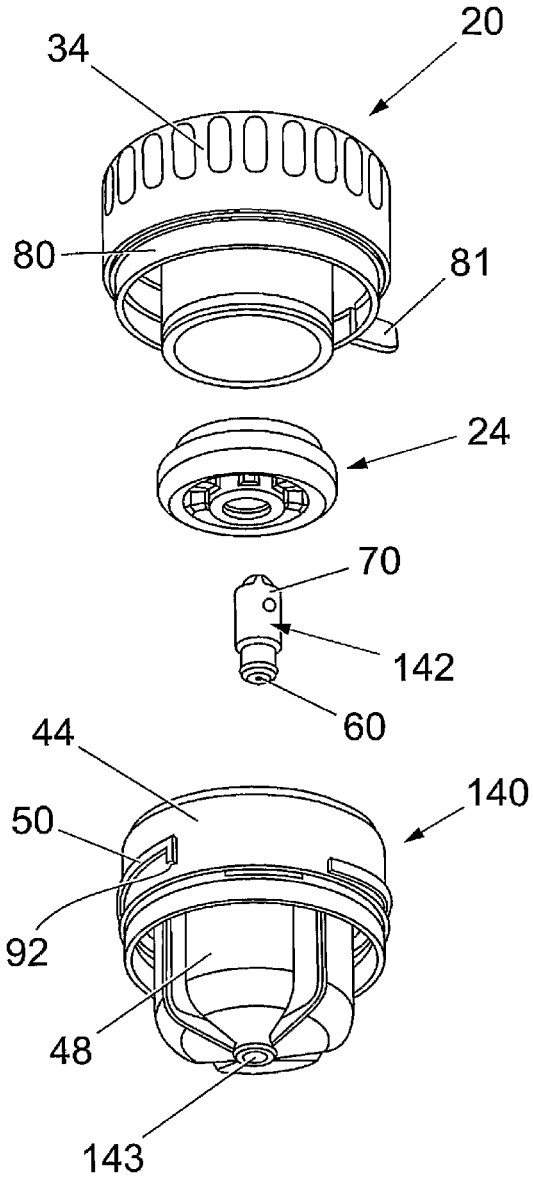
FIGS. 6A and 6B are views from below and above respectively of the components of a modified closure device according to FIG. 1.
Figure 6B:
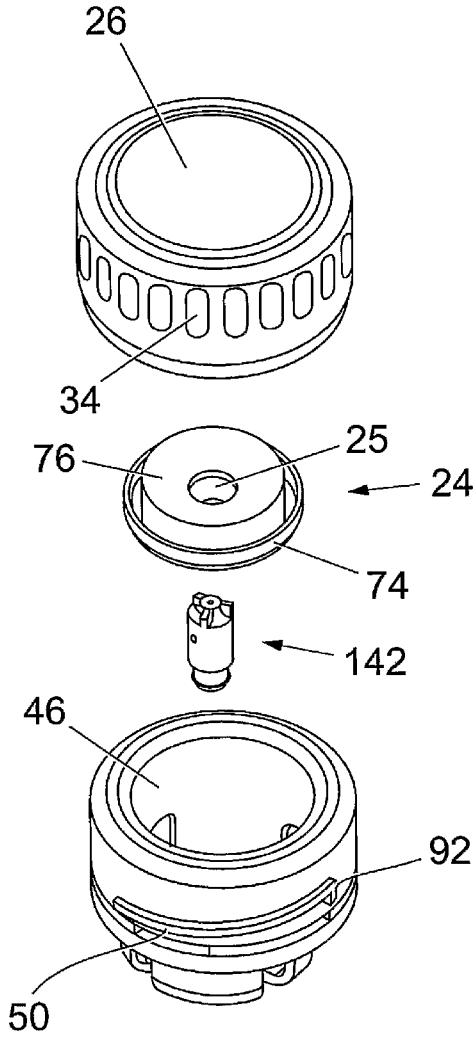

Although the plug member 42 may be formed as a unitary moulding with the remainder of the housing 40, FIGS. 6A and 6B illustrate an alternative embodiment in which the plug member 142 is formed separately and inserted by a snap fit into an aperture 143 provided in the housing. Other components of the closure device are the same as those illustrated with respect to FIGS. 1 to 5 and so are not described further. The plug member 142 may be formed of a different material to the remainder of the housing 142. This is of benefit if the housing material is incompatible with the liquid additive 120, and it is desired to make the plug member 142 of a different material which is compatible, since the plug member 142 remains in contact with the liquid additive 120 during storage. The plug member 142 may be made of metal or any suitable moulded plastic material.

Figure 7:
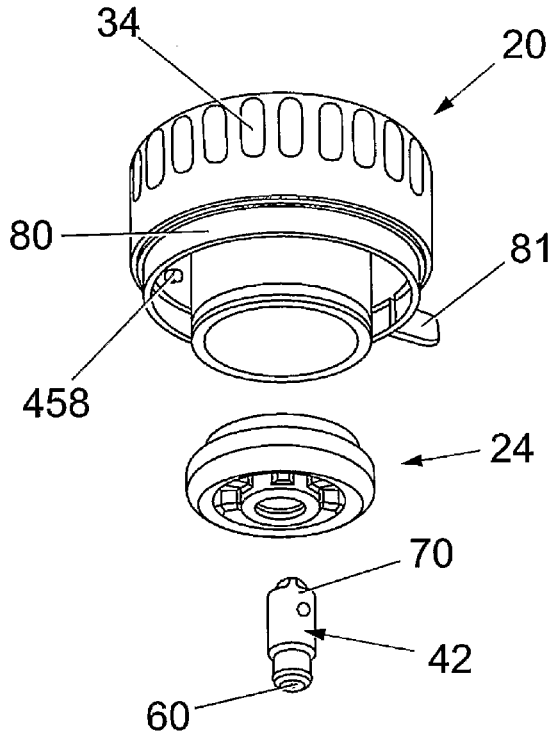
FIG. 7 is a view from below of another embodiment of a closure device according to the invention.
Figure 7:
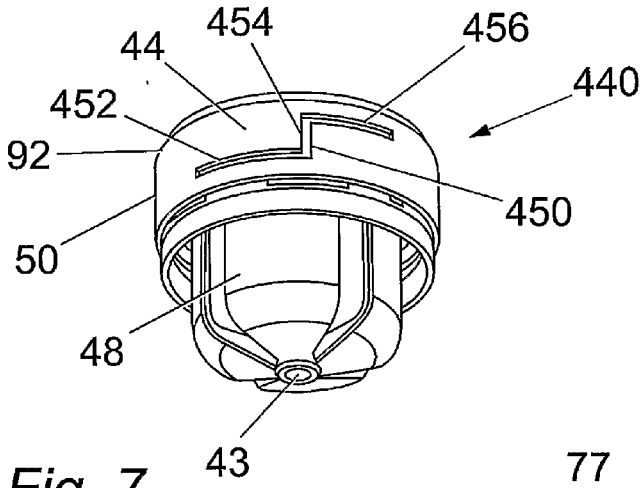

FIG. 7 shows another embodiment of the invention similar to that of FIGS. 1 to 5. Parts which are the same as those described with reference to FIGS. 1 to 5 are denoted by the same reference sign. It differs in that the internal primary thread 30 on the cap member 20 and the external primary thread 50 on the housing 40 are replaced by a pair of dogs 458 on the inside of the cap member 20 and a pair of bayonet slots 450 provided on the outer housing wall 44. The dogs 458 engage in the slots 450 to form the primary engagement means which allow the cap member 20 to be lifted relative to the housing 40.

Although only one dog and slot is illustrated, it will be understood that two or more may be arranged around the circumference of the cap member 20 and housing 40. The dog may be provided on the housing and the slots on the cap member, if required. Each bayonet slot includes a first horizontal section 452 which allows relative rotation of the cap member 20 and housing 40 in the closed position, a vertical section 454 which allows sliding of the cap member 20 relative to the housing 40 from the closed position to the open position, and a second horizontal section 456 which allows relative rotation of the cap member 20 and housing 40 in the open position. The vertical section 454 and the dogs 458 form a longitudinal guidance means.

The first horizontal section 452 may be omitted, so that when the anti-tamper strip 80 is removed no turning of the cap member 20 is required to allow the cap member 20 to slide relative to the housing 40 from the closed position to the open position. In fact the internal pressure in the fluid chamber 22 acting on the top of the plug portion 42 may be sufficient to effect this movement automatically.

The second horizontal section 456 may be omitted if it is required for the cap member 20 and housing 40 to rotate together to remove the closure member 10 from the container 12 immediately. The dog 458 and slot 450 will thus act as a mutually engaging detent means to lock the cap member 20 and housing 40 together rotationally.

FIGS. 9 to 14 show further embodiments of the invention in which parts which are the same as those described with reference to FIGS. 1-8 are denoted by the same reference sign.

Figure 11:
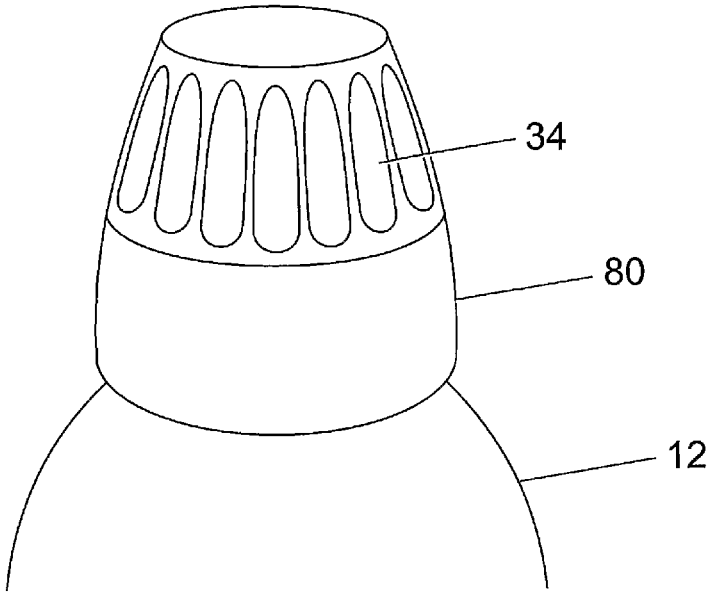
FIG. 11 is a schematic view of the closure of FIG. 10 on a bottle.
Figure 10:
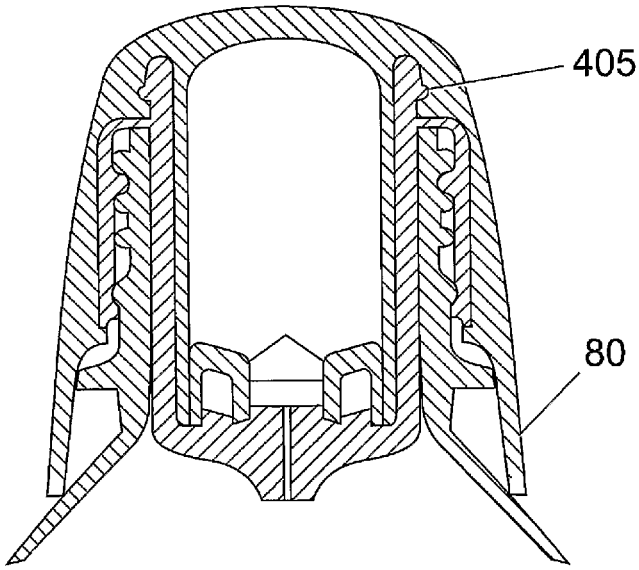
FIG. 10 is a cross-section through a closure device including the housing of FIG. 9.
Figure 9:
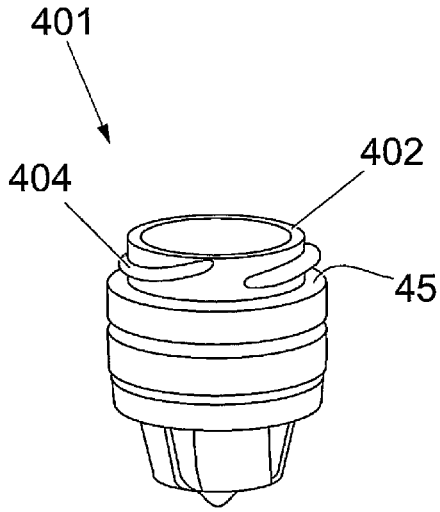
FIG. 9 is a perspective view from one side of a further alternative housing.

FIGS. 9 to 11 illustrate an embodiment in which a similar reduction in the diameter of the cap member is achieve by providing an upper portion 401 of the housing having an area of reduced diameter above the web 45 of the housing. The upper portion of the housing may be integrally formed with the remainder of the housing 40. In this embodiment, the primary engagement means is an external thread 404 on the area of reduced diameter of the housing and a corresponding internal thread 405 on the outer cap wall.

In this embodiment, the anti-tamper strip 80 of the outer cap wall 28 extends down towards the container 12 in the form of a skirt.

Figure 12:
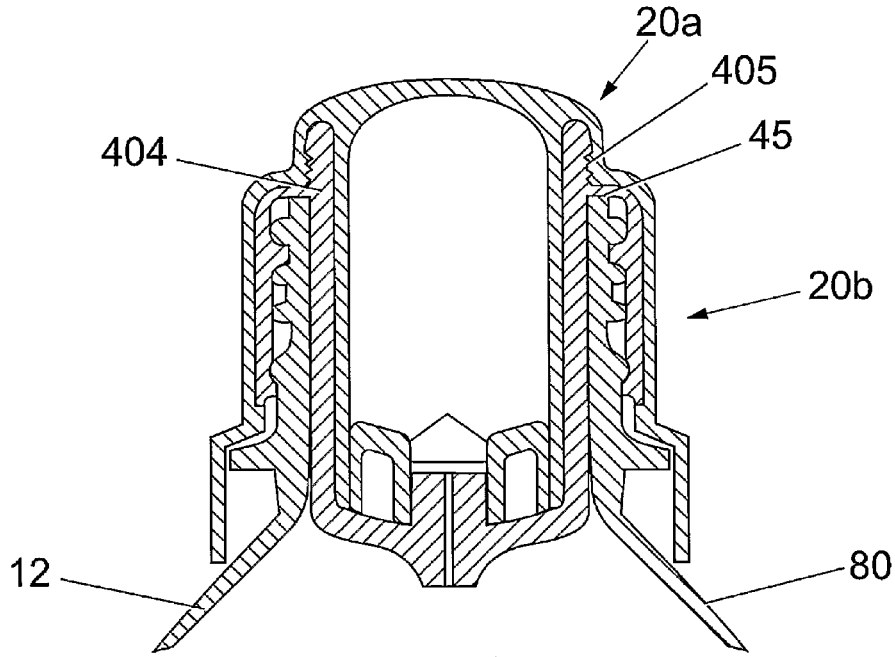
FIG. 12 is a cross-section view through a further embodiment of a closure device.
Figure 13:
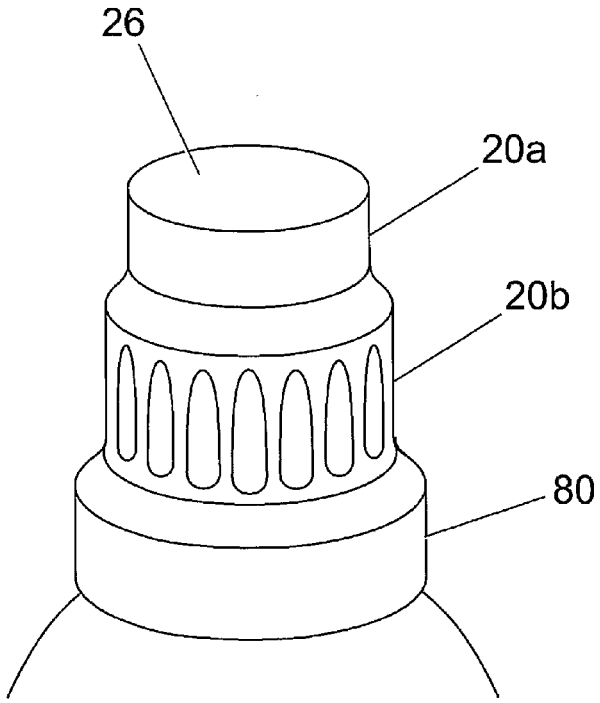
FIG. 13 is a schematic view of the closure of FIG. 12 on a bottle.

FIGS. 12 and 13 show a further embodiment of the invention similar to that of FIGS. 8 to 11 in which the height of the cap is increased to accommodate the primary engagement means between the cap and the housing in the upper part of the housing 401 above the web 45. In this embodiment, the housing is similar in form to that shown in FIG. 9 with the primary engagement means provided by an external thread 404 on the reduced diameter upper portion of the housing and an internal thread 405 on outer cap wall. By increasing the height of the cap member, the volume of the fluid chamber can be increased such that additional additive can be carried within the cap member.

The outer surface of the cap member is tiered in this embodiment. The upper part of the cap member 20*a* surrounding the upper part of the housing 401 has a reduced diameter with respect to the main part of the cap member 20*b* reflecting the reduced diameter of the upper part of the housing.

The anti-tamper strip 80 has an extended diameter with respect to the main part of the cap member 20*b* and may be extended towards the container 12 as in the previous embodiment. Upon removal of the anti-tamper strip a skirt would be left surrounding the container 12.

Figure 14:
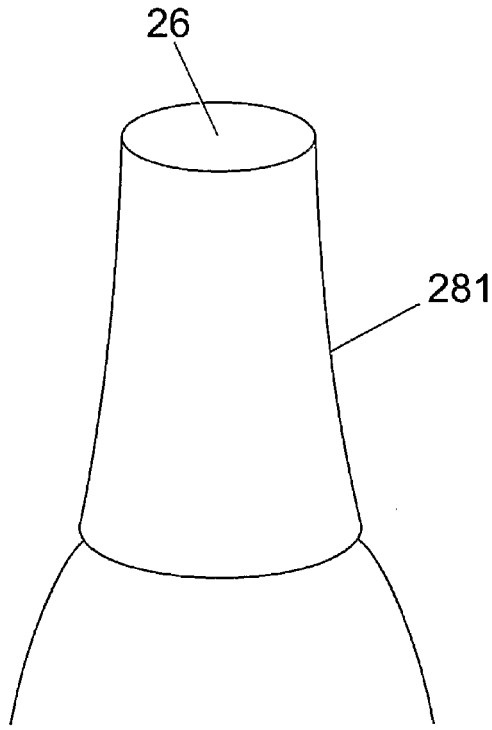
FIG. 14 is a schematic view of a still further embodiment of a closure device on a bottle.

FIG. 14 shows an embodiment of the present invention which is a further development of the embodiment of FIGS. 12 and 13. In this embodiment, the outer cap wall 281 is tapered from the top surface to the bottom of the anti-tamper strip 80 in order to provide a more aesthetic closure which may be stackable to reduce storage space within a bottling facility. The operation of this embodiment would be similar to that shown in the embodiments of FIGS. 12 and 13.

FIGS. 15 to 19 show a further embodiment of the present invention.

Figure 15:
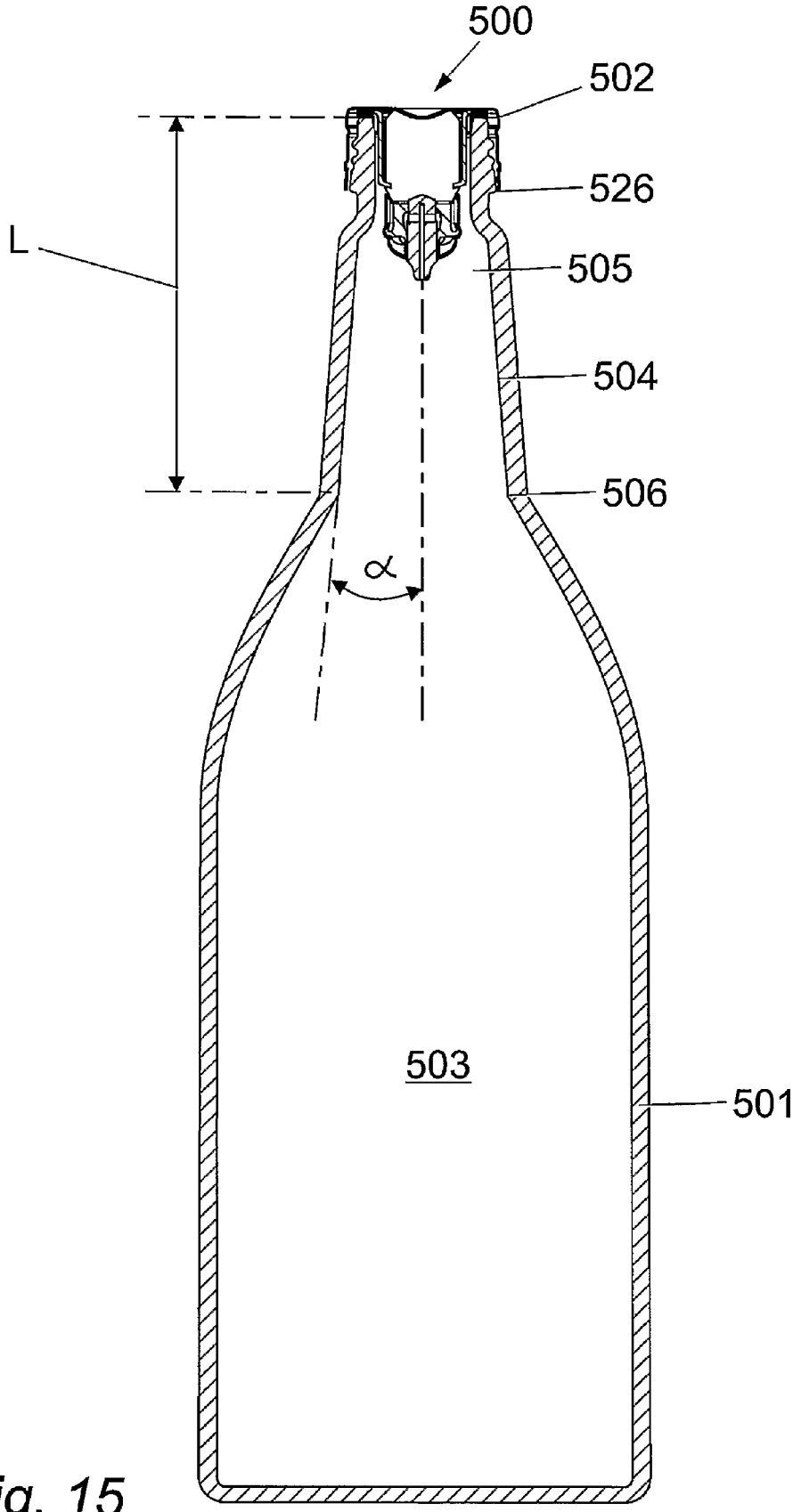
FIG. 15 is a cross-sectional view through a container fitted with a closure device according to another embodiment of the invention.

FIG. 15 shows a further embodiment of a closure device 500 fitted to a container 501. The container is a bottle 501 having a main liquid compartment 503 and a neck 504. The neck provides an opening 505 for the main liquid compartment.

The neck 504 of the bottle has a length L. The length of the neck is measured from the top of the bottle to the point of intersection with a shoulder 506 between the neck and the main liquid compartment or the main body if there is no discernible shoulder.

As will be described in more detail with reference to FIGS. 18A to 18E, the closure device 500 is adapted to release a fluid into the liquid in the bottle, and includes a cap member 502 provided with a fluid chamber 508 and an aperture 509 serving as a fluid outlet.

In this embodiment the fluid chamber 508 is generally cylindrical and is formed of stainless steel, although other materials may be used. The chamber is mounted within the cap member 502 and fixed in position via a thin layer of epoxy (not shown) provided between the upper end 510 of the chamber and the inner surface 511 of the closure of the bottle to bond the chamber to the closure. The upper end 510 of the chamber is provided with a concave portion 512 so as resist internal pressure in the fluid chamber and to assist in maintaining the bond between the chamber and the closure.

The lower end 513 of the fluid chamber is provided with an internally directed chamfered shoulder 514 which leads to the lower end of the chamber having a smaller diameter than the upper end of the chamber. The end 513 of the chamber is provided with a ferrule 516 which is rolled onto the end of the chamber and crimped in place to provide an upturned rim 517 at the lower end of the chamber. The ferrule 516 forms a bottom wall of the fluid chamber 508.

A bore or aperture 518 is provided through the ferrule 516 and the lower end of the chamber to provide a fluid passage for liquid to exit the chamber. A resilient sealing member 519 is provided within the bore 518 of the chamber. The sealing means may be a gasket or other annular body. A rim or lip may be provided internally on the inner face of the sealing member to form upper and lower sealing surfaces 520, 521.

Figure 18B:
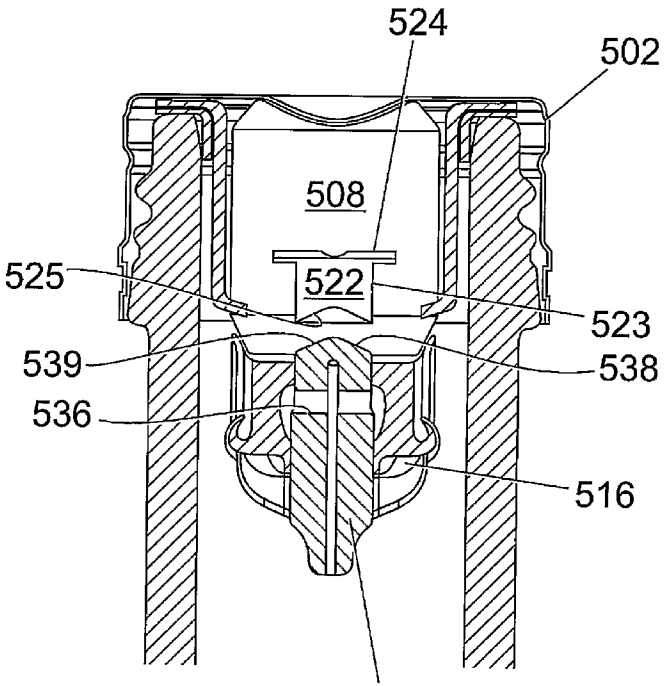
FIGS. 18A to 18E are cross sectional views of the closure device of FIG. 15 showing the device during transport of the assembly, primed for use, discharging, sealing and removal.

A plug 522, seen most clearly in FIG. 18B, is formed into the upper end of the bore within the chamber to close off the bore 518 until the fluid in the chamber is required to be mixed with the liquid in the bottle. The plug 522 may be of any suitable compatible material such as polypropylene, nylon or rubber and in the embodiment shown is formed with a substantially cylindrical portion 523, which is of a diameter only slightly less than the diameter of the bore 518 to allow the plug to rest securely within the bore, and a flange 524, which has a diameter larger than the diameter of the bore to limit the distance the plug extends into the bore. The lower end of the plug is formed with a concave surface 525 as will be described further below.

Figure 16:
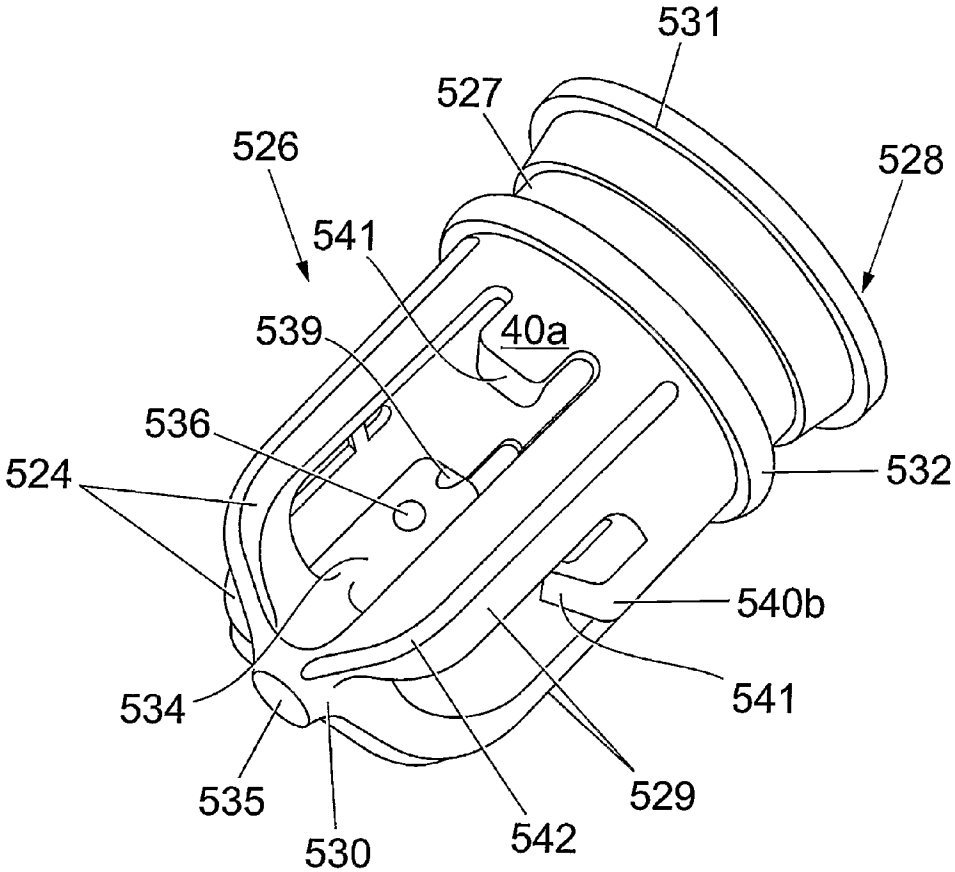
FIG. 16 is a perspective view of a housing of the closure device of FIG. 15.

The device further comprises an actuating member 526, also referred to as a housing, which is shown in FIG. 16. The terms housing and actuating member are used interchangeably in this specification. The actuating member 526 is mounted within the neck of the bottle and is formed of a suitable plastics material such as polypropylene or HDPE and comprises a substantially cylindrical housing 527 open at the upper end 528 and having a plurality of legs 529 projecting from the lower end 530.

The upper end of the actuating member 526 is provided with a lip 531 which is adapted to engage with a corresponding recess (not shown) in the neck of the bottle to ensure that the insert lies flush with the top surface of the neck of the bottle and to prevent the actuating member from being pushed down inside the neck.

Figure 17:
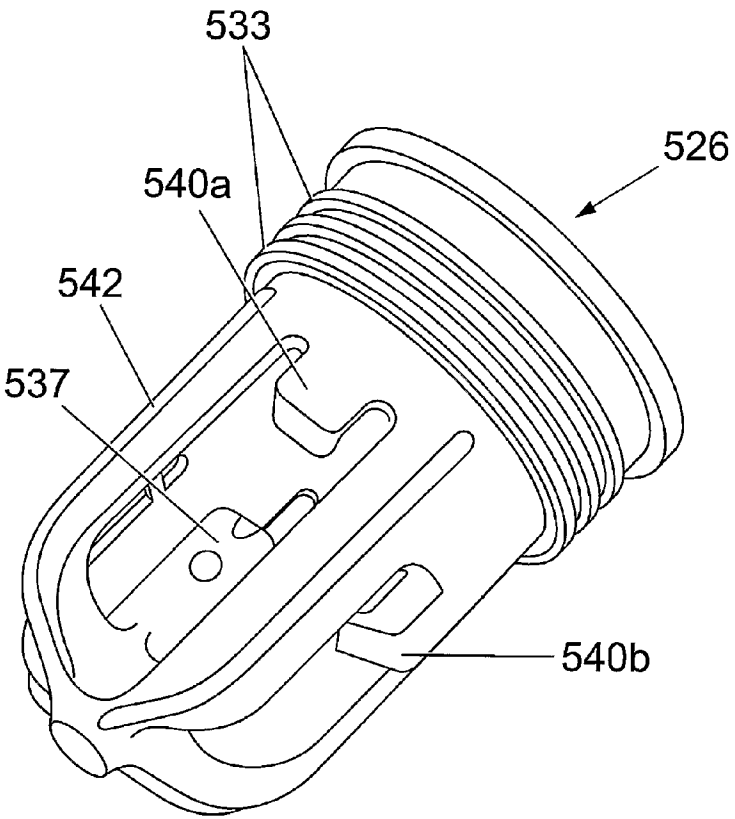
FIG. 17 is a perspective view of an alternative housing of the closure device of FIG. 15.

A resilient member 532 may be mounted around the upper end of the actuating member. This resilient member may for example be formed of a material such as Santoprene™. Alternatively one or more detents 533 may be formed in the upper end of the actuating member as shown in FIG. 17, which shows an alternative housing 526. In either case, the resilient member and the detents act to engage the inside of the neck of the bottle as will be described further below.

The legs 529 of the actuating member are connected at their lower end to a hollow spike member or plug 534 which has a small diameter bore portion 535 at its lower end. Within the wall of the small diameter bore portion are provided a number of radial passages 536 which communicate with the hollow interior of the spike. The upper portion 537 of the spike is formed with a convex surface 538 which is adapted to cooperate with the concave surface 525 of the plug member 522 within the fluid chamber. The convex upper surface of the spike is provided with one or more radial grooves 539 which extend to the edge of the convex surface.

The small diameter bore portion of the spike member may have a diameter of 0.5-2.5 mm, preferably 0.7-1.5 mm, more preferably 1.0 mm.

Retaining means 540*a*, 540*b* are integrally provided on the actuating member 526 between the legs 529. Their function is described below. In the embodiments shown the actuating member has 4 legs. The length of the body of the actuating member between two opposite pairs of legs is extended such that the retaining means form upper and lower retaining means. The free end of each retaining means 540 has an integral inwardly directed lug 541.

One or more strengthening ribs 542 may be provided along each leg 529 of the actuating member.

The lip 531 of the actuating member 526 may be provided with one or more indentations (not shown) which are adapted to cooperate with formations on the upper surface of the neck of the bottle to assist the actuating member in resisting initial rotation during use as will be described further below.

In use, the fluid chamber 508 is filled with a fluid and a pressurised gas by means of conventional technology used to fill pressurised dispenser packs, commonly known as aerosol containers. The pressure within the chamber may be between 40 to 100 psi. The actuating member 526 is placed into the neck of a bottle until the lip 531 sits flush within the recess in the neck. The bottle is filled with a liquid and the cap member 502 with the fluid chamber mounted therein is placed onto the neck of the bottle.

Figure 18A:
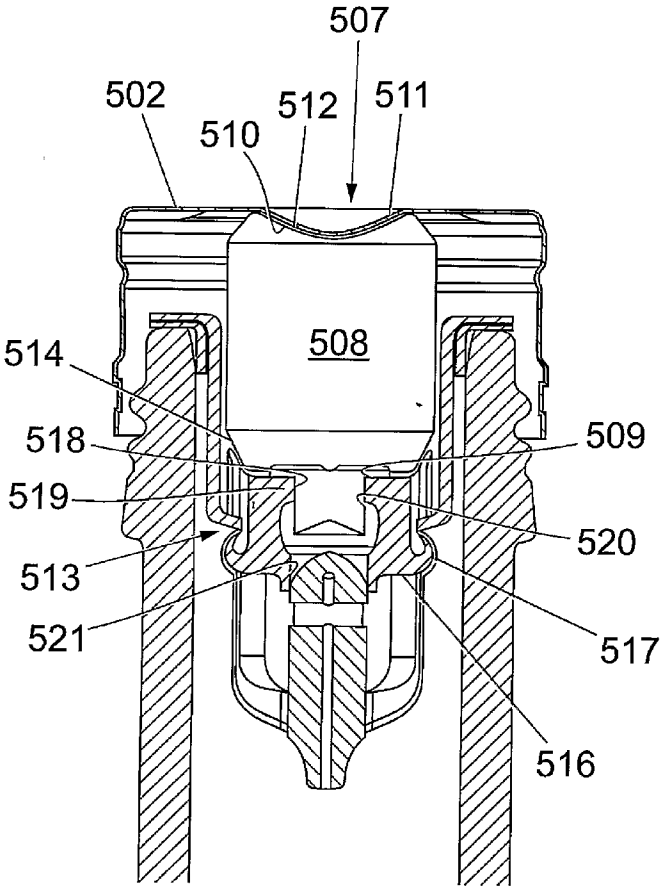

The closure is pressed down onto the bottle such that the ferrule 516 of the fluid compartment passes the inwardly directed lugs 541 on the upper retaining means 540*a* of the actuating member but not the inwardly directed lugs of the lower retaining means 540*b* such that the ferrule 516 is held in the space between both sets of lugs 541. In this condition as shown in FIG. 18A the spike 534 lies within the open end of the bore 518 but does not extend therein to contact the plug 522. The bottles can be transported or stored in this condition without risk of firing of the device.

Once transported to their required destination, and prior to use, the devices 507 are primed ready for use. This condition is shown in FIG. 18B in which the cap member 502 is pressed down firmly onto the top of the bottle. As the closure descends, the fluid chamber 508 moves downwards within the actuating member 526 and the ferrule 516 of the fluid chamber passes the lower set of inward facing lugs 541. The spike 534 moves upwardly within the bore 518 and the convex upper surface 538 of the spike engages in the concave lower surface 525 of the plug 522 in order to force the plug against the pressure within the chamber out of the bore.

The plug 522 is therefore replaced within the bore 518 by the spike 534, which itself serves as a plug member 534 sealingly engageable in the aperture 518 in the bottom wall of the fluid chamber 508. The upper sealing surface of the sealing member 519 ensures that no fluid within the chamber can pass between the sealing means 519 and the spike.

Screw threads may be formed in the closure means to hold the closure means firmly on the neck of the bottle.

The assembly remains in the condition shown in FIG. 18B until a user releases the closure from the bottle.

Figure 18C:
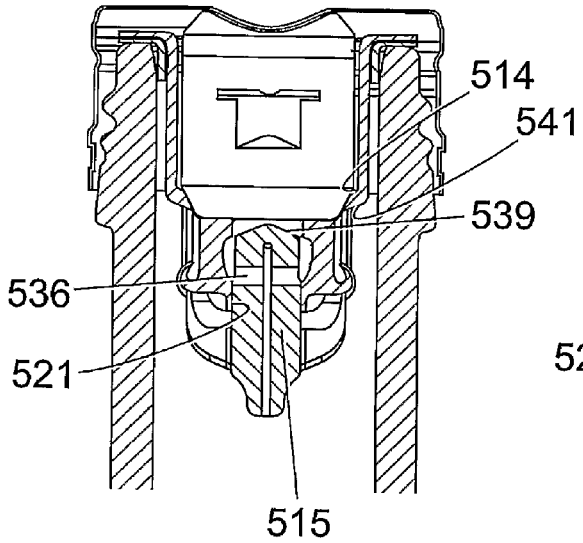

When this occurs, the cap member 502 of the closure 500 is grasped and turned. As the cap member 502 begins to turn, the actuating member 526 initially resists turning with the closure due to the resilient member 532 or detents such as in the form of protruding rings 533 which grip the inner surface of the neck of the bottle. The fluid chamber 508 therefore begins to turn and be raised with respect to the actuating member and as the chamber is raised with the cap member 502 the chamfered shoulder 514 begins to pass the upper set of inward facing lugs 541. The sealing means 519 within the chamber is raised with respect to the spike or plug member 534 thereby allowing the pressurised fluid to escape from the chamber. The fluid passes along the grooves 539 in the upper surface of the spike, past the upper sealing surface, into the radial passages 536 and thus into the small bore portion 535 of the spike where the liquid exits under force and is jetted onto the liquid contained within the bottle. This mixes the two liquids together to give the desired product. This condition is shown in FIG. 18C.

Figure 18D:
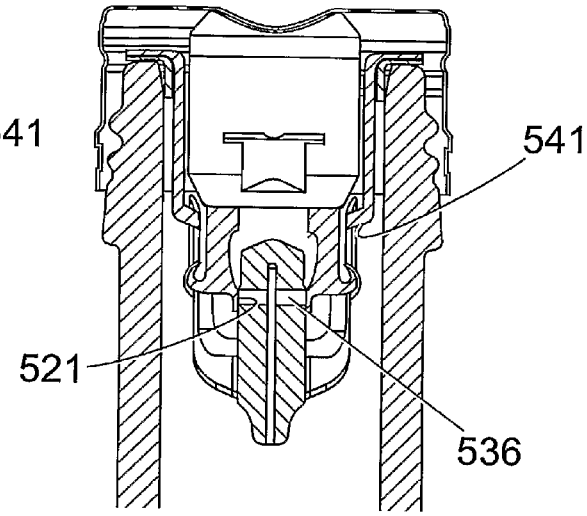

As the closure continues to be rotated the fluid chamber 508 reaches the limit of its upward travel within the actuating member 526 whereby the upper retaining means 540*a* engage below the chamfered shoulder 514. Hence the lugs 541 and the chamfered shoulder 514 and rim 517 serve as primary engagement means which allow the cap member 502 to be lifted relative to the actuating member 526. In this position, as shown in FIG. 18D, the lower sealing surface 521 of the sealing means 519 closes off the radial passageways through the spike to prevent any residue of liquid within the chamber from exiting the chamber.

Figure 18E:
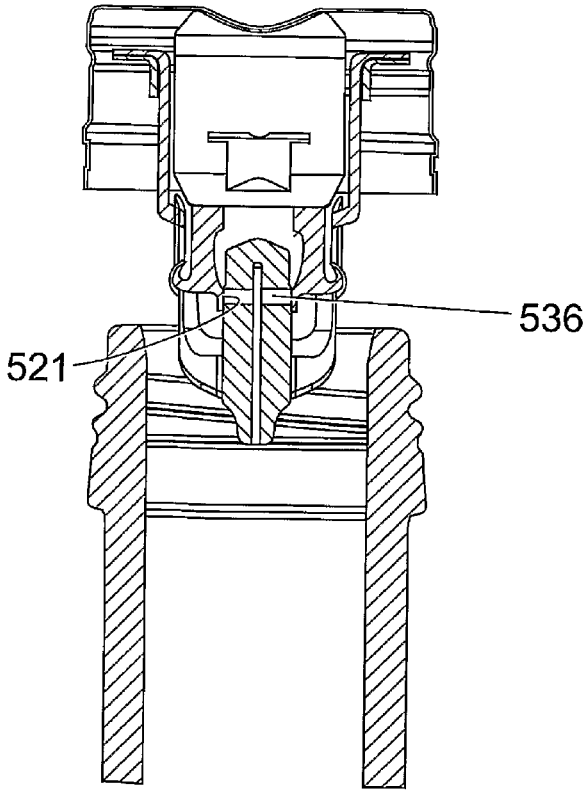

As the closure is removed from the bottle as shown in FIG. 18E the lower sealing surface of the sealing means continues to block the radial passageways 536 of the spike causing a partial vacuum within the spike thereby preventing fluid dripping from the chamber and the closure with the fluid chamber and actuating member are removed clear from the neck of the bottle thereby providing no impedance to the flow of liquid from the bottle.

Certain bottle neck designs have been tested with a device according to FIGS. 15 to 18. The tests have shown that good mixing can be obtained with neck lengths greater than 50 mm provided that the angle $\alpha$ of the interior wall of the neck with respect to the main axis is at least 3°, with an optimum for 40 to 20°. The fluid and the liquid will mix effectively provided that the angle increases as the neck lengthens.

The results of some tests are shown below in table 1.

TABLE 1

Test results

| Bottle | Neck length (mm) | Angle (degrees) | Performance | Volume (ml) |
|---|---|---|---|---|
| Bulmer's | 68 | 0 | Poor | 270 |
| Gizmo | 82 | 4.0 | Poor | 270 |
| R1 | 48 | 5.4 | Good | 330 |
| R2 | 107 | 11.1 | Good | 330 |
| R3 | 90 | 11.7 | Good | 270 |
| R4 | 72 | 16.4 | Good | 270 |

Figure 19:
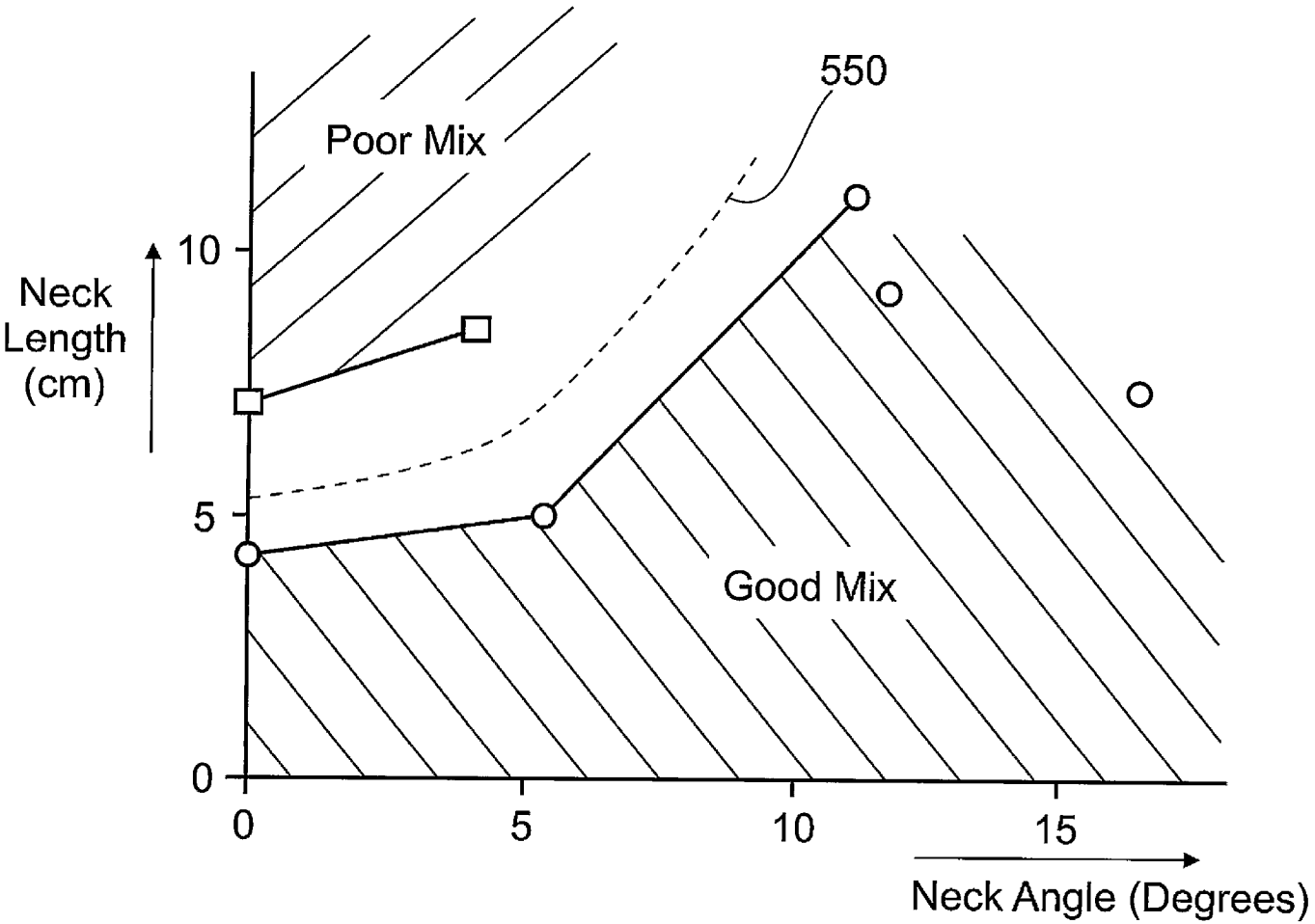
FIG. 19 shows a graphical representation of test results with a closure device according to the present invention and different bottle shapes.

FIG. 19 is a graphical representation of the test results of certain bottle designs.

The test results indicated with a square represent poor mixing. The test results indicated with a circle represent good mixing. The area below the dotted line 550 represents good mixing. It is thus advantageous to use a neck angle $\alpha$ of at least 3°, preferably in the range 4° to 20°. If the neck angle $\alpha$ is in the range 3° to 5°, the neck length should preferably be not more than 60 mm. If the neck angle $\alpha$ is in the range 5° to 10°, the neck length should preferably be not more than 100 mm. Typically the neck has a minimum internal diameter in the range 20 to 40 mm, preferably between 28 and 38 mm.

It is believed that the advantages of the neck angle may be achieved with any releasable closure device adapted to fire the contents of a fluid chamber provided in the closure device into a bottle on opening the bottle, for example any releasable closure device comprising a cap member defining a fluid chamber and a housing, the fluid chamber having an aperture in a bottom wall of the fluid chamber, wherein the cap member is provided with a primary engagement means which engages with a corresponding primary engagement means provided on the housing to allow the cap member to be lifted relative to the housing from a closed position in which the aperture is closed to an open position in which the aperture is at least partially open to provide a communication path in use from the fluid chamber to the main liquid compartment, or any other closure device described in this specification.

The present invention provides a closure device which requires fewer components than prior art devices. The closure device is simple to manufacture, as in one embodiment it requires only three moulded components, the cap member body 20, the cap member bottom wall 24 and the housing 40. The closure device can be assembled and filled with the liquid additive 120 and then stored or transported before use on a standard container 12. It does not require separate filling at the bottling location.

The closure device allows introduction and mixing of the liquid additive 120 into the contents of the main liquid compartment 14 of a container 12 without removal of the closure device 10 from the container 12.

The closure device can be used with any standard container 12, of any shape or volume, of any material, for example PET, glass, metal or any suitable plastic. The external secondary thread 18 on the neck 16 of the container 12 can be any standard thread.

The closure device optimises use of the volume within the neck 16 of the container 12, since the fluid chamber extends across the whole available area of the neck 16. The internal diameter of the fluid chamber 22 is limited only by the thickness of the inner housing wall 46 and the inner cap wall 32. The volume of the fluid chamber 22 may be varied by varying the length of the fluid chamber.

The closure device cannot be operated to introduce the liquid additive 120 into the main liquid compartment 14 unless the anti-tamper strip 80 is at least partially removed, thereby providing security to the consumer that the additive has not been mixed with the contents of the container prematurely, for example while sitting on a shelf in a shop.

The internal shape of the fluid chamber 22, which has a top surface 76 of the bottom wall 24 which slopes down towards the aperture 25 and plug member 42, ensures that only a minimum amount of residual liquid additive remains in the fluid chamber after release of the additive. Hence the closure device 190 can be removed and placed on a surface without significant deposition of additive on the surface. The sloping shape allows the full amount of liquid additive 120 to be delivered even if the container is tilted from the vertical during operation of the closure device to fire the additive.

The materials of the closure device can be selected to avoid any compatibility problems with the liquid additive 120. During storage the liquid additive is only in contact with the cap member 20 and the plug member 42. The plug member can be made separately from a different material to the remainder of the housing, if required. A liner, for example of stainless steel, can be used inside the fluid chamber to avoid contact with the moulded cap member 20, if required. Certain flavouring or colouring additives are not compatible with sealant materials. The bottom wall 24 can thus be manufactured, for example by inset moulding, so that the upper surface 76 of the bottom wall 24 is polypropylene or other suitable inert material, while the seals 64, 78 are protected below the material of the upper surface.

The closure device of the invention offers a simplified process for filling and assembling the closure device, and can be assembled and fitted to a container without the need for adhesive. The fluid chamber 22 can be easily pressurised, using any appropriate source of pressurised gas, which can simply fit to the nozzle 60 on the housing 40 once the closure device has been assembled. No specialised aerosol technology is necessary. The liquid additive 120 can be denser or more viscous, and the area of the nozzle passage 61 and internal fluid passage 70 can be increased if required, to improve the flow of a more viscous additive. Additives which require shaking to dissolve them can be used with the closure device of the invention, since it permits shaking of the container after firing with no risk of spillage through between the closure device and container, because the closure device remains sealed to the neck.

The closure device remains in one piece when removed, and can be recyclable. Recyclability is improved if the closure and housing are made of the same material.

Modifications and variations are possible without departing from the scope of the invention. In addition to the modifications and variations described above, the liquid additive may be replaced by a gel or a free flowing powder or the like. The bottom wall 24 may be formed integrally with the remainder of the cap member 20. The closure member may be used with a container holding a carbonated beverage, providing the pressure of the main liquid compartment 14 is less than the pressure of the fluid chamber 22. The primary threads 30, 50 may be of any suitable thread design, and arranged so that the closure device fires, that is ejects the liquid additive 120 into the main liquid compartment 14, after any suitable angle of rotation, for example 45°, and allows removal of the closure device from the container after any suitable further angle of rotation, for example 270° to 450°.

The invention claimed is:

1. A closure device assembled prior to fitting to a container, the container having a main liquid compartment and an opening with a neck, the assembled closure device comprising a cap member defining a pressurised fluid chamber containing an additive liquid and a housing having a plug member sealingly engageable in an aperture in a bottom wall of the fluid chamber, the plug member including a nozzle directed away from the fluid chamber, wherein the cap member is provided with a primary engagement means which engages with a corresponding primary engagement means provided on the housing to allow the cap member to be lifted relative to the housing from a closed position in which the plug member closes the aperture to an open position in which the plug member is at least partially withdrawn from the aperture to provide a communication path in use from the fluid chamber through the nozzle to the main liquid compartment.

2. A closure device according to claim 1, wherein the housing includes an inner housing wall adapted to fit inside the neck of the opening and wherein the closure device includes sealing means which seals between the fluid chamber and the inner housing wall.

3. A closure device according to claim 1, wherein the primary engagement means on the cap member includes an internal thread and the primary engagement means on the housing includes an external thread.

4. A closure device according to claim 3, wherein the cap member includes a top cap wall, an outer cap wall on which is provided the internal thread and an inner cap wall extending from the top cap wall to the bottom wall and arranged inside the outer cap wall, the fluid chamber being defined by the top cap wall, the inner cap wall and the bottom wall.

5. A closure device according to claim 3, wherein the housing comprises an outer housing wall on which is provided the external thread.

6. A closure device according to claim 5, wherein the outer housing wall is provided with an internal secondary thread adapted in use to engage with an external secondary thread provided on the neck of the opening of the container.

7. A closure device according to claim 5, wherein the housing comprises an inner housing wall arranged inside the outer housing wall and provided with internal sealing means to seal against an outer surface of the inner cap wall and external sealing means to seal against an internal surface of the neck of the opening.

8. A closure device according to claim 5, wherein the housing further comprises a frame which supports the plug member so that the plug member is arranged inside the inner housing wall and extends upwardly towards the fluid chamber in use.

9. A closure device according to claim 1, wherein the plug member includes an internal fluid passage which is sealed from the fluid chamber in the closed position and which is in fluid communication with the fluid chamber in the open position.

10. A closure device according to claim 9, wherein the plug member includes a cylindrical outer surface which engages with a sealing means provided in the bottom wall.

11. A closure device according to claim 10, wherein the sealing means comprises an upper seal which seals against the cylindrical outer surface of the plug member when the cap member is in the closed position and which allows the passage of fluid between the upper seal and the plug member when the cap member is in the open position.

12. A closure device according to claim 11, wherein the sealing means comprises a lower seal which seals against the cylindrical outer surface of the plug member when the cap member is in the closed and open positions.

13. A closure device according to claim 12, wherein the plug member includes an internal fluid passage which extends to the cylindrical outer surface at a position below the upper seal when the cap member is in the closed position, the internal fluid passage being in communication with the nozzle.

14. A closure device according to claim 1, wherein the cap member includes an anti-tamper strip provided on the cap member to prevent lifting of the cap member relative to the housing without at least partial removal of the anti-tamper strip.

15. A closure device according to claim 14, wherein the anti-tamper strip comprises an extension of an outer cap wall connected to the outer cap wall by a neck portion thinner than the outer cap wall, the extension being provided with a flange which engages beneath the outer housing wall to prevent lifting of the cap member relative to the housing.

16. A closure device according to claim 1, wherein the primary engagement means of the cap member and housing include mutually engageable detent means to prevent the rotation of the cap member relative to the housing beyond a predetermined limiting angle of rotation.

17. A closure device according to claim 1, wherein the housing includes an anti-tamper device which prevents rotation of the cap member and housing relative to the neck of the container until a predetermined torque is applied to the cap member.

18. A closure device according to claim 17, wherein the anti-tamper device comprises an extension of an outer housing wall connected to the outer housing wall by at least one neck portion of reduced cross-sectional area relative to the outer housing wall, the extension being provided with a detent means adapted to engage in use with a detent means provided on the neck of the container to prevent lifting of the housing relative to the neck without rupture of the at least one neck portion.

19. A closure device according to claim 1, wherein the bottom wall includes a frame portion formed from a first relatively rigid material and a second sealing portion formed from a second relatively flexible material.

20. A closure device according to claim 19, wherein the cap member includes a top cap wall, the bottom wall and an inner cap wall extending from the top cap wall to the bottom wall, together defining the fluid chamber, and wherein the sealing portion is arranged to seal against the inner cap wall.

21. A closure device according to claim 19, wherein the sealing portion is arranged to seal between the aperture and the plug member.

22. A closure device according to claim 19, wherein the top cap wall and inner cap wall comprise a single moulded component and the bottom wall comprises a separate moulded component.

23. A closure device according to claim 1, wherein the fluid chamber contains a head space of pressurised gas.

24. A container having a main liquid compartment, an opening having a neck, and a closure device according to claim 1 closing said opening, wherein the housing of the closure device is secured to the neck of the container.

25. A container according to claim 24, wherein the main liquid compartment contains a primary liquid.

26. A container according to claim 25, wherein the primary liquid is a beverage.

27. A container according to claim 26, wherein the housing comprises an outer housing wall, which is located outside the neck of the container and is provided with an internal secondary thread engaged with an external secondary thread provided on the neck of the container.

28. A container according to claim 24, wherein the housing further comprises an inner housing wall arranged inside the neck of the container and provided with internal sealing means to seal against an outer surface of the inner cap wall and external sealing means to seal against an internal surface of the neck of the opening.

29. A method of assembling a closure device containing additive liquid for introduction into a main liquid compartment of a container, the method comprising the steps of:

providing a cap member, securing a bottom wall to said cap member to define a pressurisable fluid chamber, inverting the cap member and introducing an additive liquid into the fluid chamber through an aperture in the bottom wall, providing a housing having a plug member, the plug member including a nozzle directed away from the fluid chamber, attaching the housing to the cap member by relative axial movement of the housing and cap member so that the plug member enters and closes the aperture in the bottom wall of the fluid chamber, pressurising the fluid chamber, and storing the closure device with the pressurised chamber containing the additive liquid for subsequent fitting to a container.

30. A method according to claim 29, wherein an inner housing wall of the housing seals against the fluid chamber.

31. A method according to claim 29, whereby the relative axial movement of the housing and cap member is accomplished by engagement of an external thread on the housing with an internal thread on the cap member.

32. A method according to claim 31, wherein the pressurising step is accomplished by providing pressurised fluid to a passage in said plug member, the passage being in communication with a valve means which prevents release of the pressurised fluid from the fluid chamber.

33. A method according to claim 32, wherein the valve means comprises a seal which engages with the plug member when the aperture is closed by the plug member.

34. A method according to claim 32, wherein the pressurised fluid is a gas and the gas forms a head space in the fluid chamber of between 0% and 60% of the volume of the fluid chamber.

35. A method according to claim 29, wherein the step of securing the bottom wall to the cap member includes sealing the bottom wall to a free edge of an inner cylindrical wall of the cap member.

36. A method according to claim 29, including the further step of securing the closure device to a neck of a container having a main liquid compartment by engagement of an internal thread on the housing with an external thread on the neck of the container.

37. A method according to claim 29, wherein the closure device is a closure device assembled prior to fitting to a container having a main liquid compartment and an opening with a neck, the assembled closure device comprising a cap member defining a pressurised fluid chamber containing an additive liquid and a housing having a plug member sealingly engageable in an aperture in a bottom wall of the fluid chamber, the plug member including a nozzle directed away from the fluid chamber, wherein the cap member is provided with a primary engagement means which engages with a corresponding primary engagement means provided on the housing to allow the cap member to be lifted relative to the housing from a closed position in which the plug member closes the aperture to an open position in which the plug member is at least partially withdrawn from the aperture to provide a communication path in use from the fluid chamber through the nozzle to the main liquid compartment.

38. A method of introducing an additive liquid into a main liquid compartment of a container having an opening with a neck, the neck having attached to it a closure device comprising a housing attached to the neck and a cap member defining a pressurised fluid chamber attached to the housing, wherein the closure device is assembled and filled with the additive liquid prior to attachment to the neck, the method comprising the steps of:

raising the cap member on the housing, causing a plug member provided on said housing to move relative to the cap member from a closed position in which an aperture provided in a bottom wall of said fluid chamber is closed by said plug member to an open position in which the plug member is at least partially withdrawn from the aperture to provide a communication path from the fluid chamber through a nozzle provided in the plug member and directed away from the fluid chamber, and releasing the pressurised additive liquid from said fluid chamber along said communication path into said main liquid compartment.

39. A method according to claim 38, wherein during the raising of the fluid chamber relative to the housing a seal is maintained between the fluid chamber and an inner housing wall of the housing arranged in the neck of the container.

40. A method according to claim 38, wherein the cap member is raised by rotating the cap member through a first angle in order to raise the fluid chamber relative to the housing.

41. A method according to claim 40, wherein the first angle is a limiting angle of rotation between 0 and 90 degrees.

42. A method according to claim 40, wherein further rotation of the cap member by more than the first angle relative to the housing is prevented by the mutual engagement of detent means provided on the cap member and housing.

43. A method according to claim 38, wherein the raising of said cap member relative to the housing is achieved by engagement of an internal thread on the cap member with an external thread on the housing.

44. A method according to claim 43, wherein the internal thread is provided on an outer cap wall of the cap member.

45. A method according to claim 43, wherein the external thread is provided on the outer face of an outer housing wall.

46. A method according to claim 38, wherein the fluid chamber is defined by a top cap wall, a bottom wall and an inner cap wall extending from the top cap wall to the bottom wall and arranged inside the outer cap wall.

47. A method according to claim 38, including the further step of rotating the cap member further to remove the cap member and housing from the container by engagement of an internal secondary thread on the housing with an external secondary thread provided on the neck of the opening of the container.

48. A method according to claim 47, wherein the internal secondary thread is provided on the inner face of an outer housing wall.

49. A method according to claim 48, wherein the inner cap wall extends inside the neck of the container.

50. A method according to claim 47, further including the step of applying sufficient torque to the cap member, during the step of rotating the cap member further to remove the cap member and housing from the container, to remove an anti-tamper device.

51. A method according to claim 38, wherein the housing includes an inner housing wall arranged inside the neck of the container, and provided with sealing means to seal between an outer surface of the inner housing wall and an internal surface of the neck of the container.

52. A method according to claim 38, wherein, during the raising of said cap member relative to the housing, a sealing means seals between an external surface of the inner cap wall and an internal surface of the inner housing wall.

53. A method according to claim 38, wherein the communication path includes an internal fluid passage in the plug member which extends from the nozzle to a position on the surface of the plug member which is in communication with the fluid chamber when the plug member is in the open position.

54. A method according to claim 38, further including the step of at least partially removing an anti-tamper strip provided on the cap member, thereby allowing raising of the cap member relative to the housing.

* * * * *